US011298911B2

(12) United States Patent
Boegli et al.

(10) Patent No.: US 11,298,911 B2
(45) Date of Patent: Apr. 12, 2022

(54) METHOD AND EMBOSSING STRUCTURE USING HIGH DENSITY PRESSURE FOR CREATING SHADOWED OR CURVED HIGHLY REFLECTIVE AREAS ON ROTATIONALLY EMBOSSED FOILS

(71) Applicant: Boegli-Gravures SA, Marin-Epagnier (CH)

(72) Inventors: Charles Boegli, Marin-Epagnier (CH); Alain Droz, Marin-Epagnier (CH); Werner Steffen, Marin-Epagnier (CH)

(73) Assignee: Boegli-Gravures SA, Marin-Epagnier (CH)

( * ) Notice: Subject to any disclaimer, the term of this patent is extended or adjusted under 35 U.S.C. 154(b) by 316 days.

(21) Appl. No.: 16/618,185

(22) PCT Filed: Jan. 31, 2018

(86) PCT No.: PCT/IB2018/050602
§ 371 (c)(1),
(2) Date: Nov. 29, 2019

(87) PCT Pub. No.: WO2018/229557
PCT Pub. Date: Dec. 20, 2018

(65) Prior Publication Data

US 2021/0154964 A1 May 27, 2021

(30) Foreign Application Priority Data

Jun. 14, 2017 (EP) ..... 17175901

(51) Int. Cl.
*B31F 1/07* (2006.01)
*B44B 5/00* (2006.01)
*B44B 5/02* (2006.01)

(52) U.S. Cl.
CPC ..... *B31F 1/07* (2013.01); *B44B 5/0047* (2013.01); *B44B 5/026* (2013.01);
(Continued)

(58) Field of Classification Search
CPC ..... B31F 1/07; B31F 2201/0733; B31F 2201/0738; B31F 2201/0743; B31F 2201/0753; B44B 5/0047; B44B 5/026
See application file for complete search history.

(56) References Cited

U.S. PATENT DOCUMENTS 3,673,839 A 7/1972 Nielsen et al.
4,543,142 A * 9/1985 Kuepper ..... B31F 1/07 156/209

(Continued)

FOREIGN PATENT DOCUMENTS

AU 772613 B2 5/2004
CA 2382597 A1 11/2000

(Continued)

OTHER PUBLICATIONS

International Preliminary Report on Patentability of PCT/IB2018/050602 dated Jun. 25, 2019.

(Continued)

*Primary Examiner* — David H Banh
(74) *Attorney, Agent, or Firm* — Andre Roland SA; Nikolaus Schibli

(57) ABSTRACT

A method of embossing individually light reflecting areas on a foil material, the method comprising feeding a foil material into a roller nip between a pair of rollers, wherein the pair of rollers comprises a motor roller and a counter roller, providing each of the motor roller and counter roller at least in a determined perimeter with a plurality of positive and negative projections on a checkered layout whereby positive and negative projections alternate in axial and radial direc- (Continued)

tions. The method further comprises that the plurality of positive and negative projections of the counter roller seamlessly and gaplessly join with those corresponding negative and positive projections of the motor roller at the intended embossing of the foil material, hence enabling a homogeneously jointed embossed polyhedron shape in the foil, and shaping each positive and negative projection on the motor roller as an n-cornered polyhedron with a specific surface intended to produce on the embossed foil surface a corresponding individually light reflecting area, for each positive projection its specific surface corresponding to its top side, and for each negative projection its specific surface corresponding to its bottom side.

15 Claims, 17 Drawing Sheets

(52) U.S. Cl.
CPC ..... *B31F 2201/0733* (2013.01); *B31F 2201/0738* (2013.01); *B31F 2201/0743* (2013.01); *B31F 2201/0753* (2013.01)

(56) References Cited

U.S. PATENT DOCUMENTS

| | | | | |
|---|---|---|---|---|
| 4,759,967 | A * | 7/1988 | Bauernfeind | D21H 27/40 428/153 |
| 4,921,034 | A * | 5/1990 | Burgess | B31F 1/07 162/109 |
| 5,007,271 | A | 4/1991 | Boegli | |
| 5,366,785 | A * | 11/1994 | Sawdai | D21F 11/006 162/109 |
| 5,598,774 | A | 2/1997 | Boegli | |
| 6,080,276 | A | 6/2000 | Burgess | |
| 6,176,819 | B1 | 1/2001 | Boegli et al. | |
| 6,302,998 | B1 * | 10/2001 | Burgess | B31F 1/07 162/109 |
| 6,665,998 | B1 | 12/2003 | Boegli | |
| 6,715,411 | B1 | 4/2004 | Boegli | |
| 6,755,928 | B1 | 6/2004 | Biagiotti | |
| 6,846,172 | B2 * | 1/2005 | Vaughn | B31F 1/07 101/23 |
| 7,036,347 | B2 | 5/2006 | Boegli | |
| 7,147,453 | B2 | 12/2006 | Boegli | |
| 7,229,681 | B2 | 6/2007 | Boegli | |
| 7,297,226 | B2 * | 11/2007 | Schulz | B31F 1/07 162/117 |
| 8,038,922 | B2 | 10/2011 | Boegli | |
| 8,430,663 | B2 | 4/2013 | Boegli | |
| 8,495,900 | B2 | 7/2013 | Boegli | |
| 8,932,044 | B2 | 1/2015 | Boegli | |
| 9,140,834 | B2 | 9/2015 | Boegli | |
| 9,156,107 | B2 | 10/2015 | Boegli et al. | |
| 9,180,643 | B2 | 11/2015 | Boegli | |
| 9,481,141 | B2 | 11/2016 | Boegli | |
| 9,505,167 | B2 | 11/2016 | Boegli | |
| 9,579,924 | B2 | 2/2017 | Boegli | |
| 9,636,885 | B2 | 5/2017 | Boegli et al. | |
| 9,809,927 | B2 | 11/2017 | Boegli | |
| 9,939,725 | B2 | 4/2018 | Boegli et al. | |
| 9,993,895 | B2 | 6/2018 | Boegli et al. | |
| 10,083,253 | B2 | 9/2018 | Boegli et al. | |
| 10,183,318 | B2 | 1/2019 | Boegli et al. | |
| 2005/0279147 | A1 | 12/2005 | Boegli | |
| 2010/0061619 | A1 | 3/2010 | Boegli | |
| 2012/0018993 | A1 | 1/2012 | Boegli et al. | |
| 2012/0292821 | A1 | 11/2012 | Boegli | |
| 2014/0059977 | A1 | 3/2014 | Boegli | |
| 2016/0075077 | A1 | 3/2016 | Boegli et al. | |
| 2017/0066079 | A1 | 3/2017 | Reisse et al. | |
| 2017/0282635 | A1 | 10/2017 | Boegli et al. | |
| 2018/0220698 | A1 | 8/2018 | Boegli et al. | |
| 2018/0370175 | A1 | 12/2018 | Boegli et al. | |

FOREIGN PATENT DOCUMENTS

| | | | |
|---|---|---|---|
| CA | 2367423 | C | 5/2008 |
| CN | 1291938 | A | 4/2001 |
| DE | 202017105458 | U1 | 10/2017 |
| DK | 131333 | | 6/1975 |
| EP | 0925911 | B2 | 11/2006 |
| EP | 1324877 | B | 11/2006 |
| EP | 2572820 | A1 | 3/2013 |
| EP | 2653301 | A1 | 10/2013 |
| EP | 3300612 | A1 | 4/2018 |
| EP | 3415306 | A1 | 12/2018 |
| GB | 1 312 359 | | 4/1973 |
| RU | 2308377 | C1 | 10/2007 |
| RU | 150088 | U1 | 1/2015 |
| RU | 2592195 | C2 | 7/2016 |
| RU | 2620044 | C2 | 5/2017 |
| WO | WO 2007/012215 | | 2/2007 |
| WO | WO 2017/208092 | | 12/2017 |
| WO | WO 2018/116156 | | 6/2018 |

OTHER PUBLICATIONS

International Search Report (ISR) of PCT/IB2018/050602 dated May 14, 2018.

Written Opinion (WO) of the International Search Authority of PCT/IB2018/050602 dated May 14, 2018.

Chinese 1st Office Action dated May 28, 2020 for application N° CN 201880052248.9.

Russian Office Action dated Mar. 30, 2021 for application RU 2019142674.

Russian Search Report dated Mar. 30, 2021 for application RU 2019142674.

* cited by examiner

METHOD AND EMBOSSING STRUCTURE USING HIGH DENSITY PRESSURE FOR CREATING SHADOWED OR CURVED HIGHLY REFLECTIVE AREAS ON ROTATIONALLY EMBOSSED FOILS

CROSS REFERENCE TO RELATED APPLICATIONS

The present application is a United States national stage application of International patent application PCT/IB2018/050602 that was filed on Jan. 31, 2018 designating the United States, and claims foreign priority to European patent application EP 17175901.2 that was filed on Jun. 14, 2017, the contents of both documents being herewith incorporated by reference in their entirety.

TECHNICAL FIELD

The invention is in the field of foil embossing. More particularly the invention relates to a method for making checkered style embossings as described in International patent application W02018116156, which is incorporated herein by reference, and for providing corresponding embossing rolls, and their use in a pair of embossing rolls for providing foils with shadowed areas.

BACKGROUND

The area of fine embossing of thin foils having a thickness in an approximate range from 30 μm to 120 μm using the rotational process, the foils being intended for packaging uses or decorative purposes, has been gaining in interest since the 1980s.

It is well known in the tobacco industry and food industries to emboss packaging foils using rotational embossing with rolls. Such packaging foils may for example be so-called innerliners that are intended to be wrapped around a bunch of cigarettes, or to be used as packaging material for chocolate, butter or similar food products, as well as electronics, jewelry or watches.

The innerliners used to be made from pure aluminum foils, such as aluminum foils used in households. These foils were embossed by feeding them into a roll nip between a pair of rolls. At least one the rolls comprised a topographical structure that defined for example a logo. Until the 1980s such a pair of rolls would comprise mostly one steel roll on which a profile would be formed, and a counter roll made from a resilient material, e.g., rubber, paper or Plexiglas. The imprinting or embossing of the profile of the logo-carrying roll, also called the pater roll, into the counter roll, also called the mater roll, would allow to obtain the mirror imprint of the logo in the foil.

More demanding logos would require to reproduce the topography of the pater roll in a layer of the mater roll, and the recessed parts on the mater roll corresponding to elevated parts of the pater roll would be excavated by etching or any other appropriate process. More recently such excavating and carving as been obtained using lasers. Since the achievable mechanical tolerances using mechanical tools were limited, the recesses could only be made in a relatively coarse grid, and were then used in the cooperation between a dedicated pater roll and mater counter roll. It was therefor always necessary to produce spare rolls in pairs, which is expensive. This made the manufacturing of such rolls prohibitively expensive for industrial embossing of for example innerliners for the tobacco industry.

In the search for an alternative embossing solution, from 1980 on, and following the filing of US patent application underlying U.S. Pat. No. 5,007,271 to the present applicant, a so-called pin up-pin up system has been introduced, wherein two identical steel rolls carrying a very large number of small teeth that intertwine to grip between each other and emboss paper that is fed in between. Logos are embossed by leaving out teeth entirely or partly from one of the rolls. Technical manufacturing constraints imposed between a roll and the counter roll a distance of a half step-length—this prohibited any brilliant embossing if any risk of perforating the material to be embossed was to be avoided.

Furthermore the pin up-pin up made it possible to produce a so-called satinizing effect whereby a large number of small recesses produced by the teeth give to the surface a matt, velvet-like appearance—which incidentally confers a more distinguished look to the embossed material.

Parallel to the evolution in the embossing technology and the manufacture of embossing rolls, there was also a change in the area of packaging materials. The initially massive aluminum foils were replaced by paper foils, the surfaces of which were coated with a thin metal layer, which has been getting thinner ever since the beginning for obvious environmental reasons. Most recently the metal layer was sputtered on the paper surface. It is expected that the metallization of the paper surface will become even thinner in future, or perhaps entirely disappear.

There are also considerations to depart from the classic cigarette packaging, wherein the cigarettes are wrapped in an innerliner, and this pack of wrapped cigarettes is stuck into a cardboard case. It is aimed to use instead a so-called soft-package, wherein there is merely an outer wrapping foil that performs both functions of firstly keeping the humidity inside the cigarettes and protecting the cigarettes from outer odors, and secondly conferring a determined stiffness to the package to mechanically protect the cigarettes.

The development of the roll manufacturing technology, in particular as known from the present applicant in for example U.S. Pat. No. 7,036,347, is allowing an ever larger diversity of decorative effects on innerliners and attractive visual effects for publicity. This is widely being used in the tobacco industry and in the food industry. There is however an incentive to reduce and sometimes eliminate the publicity, and hence it will not anymore be possible to emboss visually effective publicity to the same extent as today.

It is to be considered also that a fine embossing may only be achieved at the expense of a high cost and tremendous efforts for the manufacturing of appropriate rolls. Also, in such a case, when a pater roll and an inversely congruent mater roll are used to compress a foil that is passed between them, there are tensions produced in axial direction, which are no longer acceptable for the tobacco product paper. Moreover, there is a difficult to master limit to the occurrence of holes and very high pressures are required in a high-speed foil embossing process, in which the embossing time lies in the millisecond range. Finally, there appears to be a tendency to use thicker qualities of foil.

Patent publication EP 3 038 822 describes fine embossing for surface structures as described and mentioned herein above, and for various types of materials in an online process, whereby this encompasses figurative patterns and topographies. In EP 3 038 822 fine embossing comprises that the outlines of fine embossing structures on the rolls have a total linear mistake of less than +/−10 μm and an angle error of less than 5°.

Inverse congruent pairs of rolls allow as described in EP 3 038 822 to produce surface logos without having unacceptable tension in axial direction.

The solution of EP 3 038 822 is adapted mostly for relatively restricted surfaces.

Coming back to the already discussed pin up-pin up technology, this made it possible to produce a so-called satinizing whereby a large number of small recesses produced by the teeth give to the surface a matt, velvet-like appearance—which incidentally confers a more distinguished look to the embossed material. This technology has continued to be developed by the present applicant, and EP 0 925 911 B2 to the applicant describes a satinizing embossing by means of which, as described in column 4, line 18 of the publication, one tooth of a roller is surrounded at the time of embossing by 4 teeth of the counter roller, whereby this is in a rather lose manner in which the teeth only come into contact along their edges. Also, as described in column 3, line 48 of the publication, there is a relative axial play with which the rollers are mutually displaceable, which preferably corresponds to 0.75 of the tooth pitch. Hence the rollers are axially displaceable.

The publication EP 1 324 877 B1 to the present applicant, describes a system for making embossings that embosses packaging foils with signs that produce viewing position and/or light source dependent optical effects, hence enabling esthetic and security features. This is obtained with non-diffracting, but light reflecting topographical relief elements. Furthermore, it is essential for the use of the optical effects, that there be a reflecting layer (sputtered or laminated) on the foil, and that this layer has a sufficient reflectivity in the visible spectrum. As described in ¶10 of the publication, the effect is obtained using two rollers, one roller comprising non-modified teeth T1 and modified relief teeth T2—see FIG. 4—and the other roller comprising non-modified satinizing teeth T1 only—see FIG. 3, whereby the teeth from both rollers intertwine as shown in FIG. 5.

The process as described in publication EP 1 324 877 B1 does not take into consideration the already described evolution of the foils, since the increased requirements for brilliance and uniform pressure cannot anymore be achieved solely by means of teeth contact at the edges. The process accordingly merely produces a product by which the illuminating intensity is only reflected as a beam, which is diminished in intensity.

Prior art patent publication DK131333 teaches a checkered and uniform embossing pattern such as the one shown in FIG. 1. This embossing pattern is intended for the embossing of textile products. The embossing pattern comprises a plurality of positive projections and negative projections marked with P and N respectively. The embossing pattern is for an embossing system, which makes use of a pair of rolls, whereby the textile product is fed into a roll nip between the pair of rolls. The positive projections and negative projections P and N are identically shaped polyhedral structures, whereby the positive projections P are symmetrically shaped relative to the negative projections N when considered from the mean surface. FIG. 1 further shows hills marked with the letter H, which are parts of the roll's cylindrical surface, that are located at the previously mentioned mean surface, and that will produce no embossing, i.e., the hills H do not comprise any projections.

European patent application EP16205224.5 to the applicant makes use of the idea from the embossing pattern shown in DK131333, except that it does away with the hills H in the embossing pattern. This is, for example, shown in FIG. 2*a* which illustrates an example of the embossing pattern used. FIG. 2*b* shows a layout plan of projections corresponding to embossing structures from FIG. 2*a*. It is to be noted that EP16205224.5 provides a solution for fine embossing that allows producing checkered-style and larger uniformly embossed areas in a step length of about 50 to 250 μm. The use of the embossing pattern of FIG. 2*a* and a corresponding inverse embossing pattern on respective rolls of a pair of embossing rolls, to emboss a foil or innerliner would confers a 100% embossing coverage of the embossed surface. Using this embossing pattern, it is possible to obtain a homogeneous distribution of pressure to the material, i.e., a regular and homogenous balance between the pressure on the lateral oblique surfaces of the positive projections P and negative projections N. Furthermore, axial contraction of the embossed foil is reduced and a smoother surface is obtained compared to the older embossing technologies of the applicant. More particularly, the embossing according to EP16205224.5 is with a pair of rollers using on a first of the rollers a checkerboard-like embossing pattern of positive projections and negative projections, the checker board having for the sake of explanation imaginative black and white squares, whereby the positive projections are on the imaginative black squares, and the negative projections are on the imaginative white squares, and on a second of the rollers a matching embossing pattern which is positioned such that at a time of embossing, both embossing patterns interact like congruent structures to emboss the foil product such that each of the projections on each roll becomes surrounded on all sides by projections of the other roll. The optical reflective effect produced by the embossed product is a shading effect that darkens the embossed product being viewed, i.e., less light amplitude is reflected at a determined viewing angle.

Aim of the Invention

It is an aim of the invention to provide an apparatus and a roller pair for a rotative embossing of structures in metalized foils, which produce optical reflective effects for decorative and security features, departing from technology described in EP16205224.5 and herein above, more particularly the embossing with a pair of rollers using on a first of the rollers a checker board like embossing pattern of positive projections and negative projections, whereby the positive projections are on the imaginative black squares, and the negative projections are on the imaginative white squares, and on a second of the rollers a matching embossing pattern which is positioned such that at a time of embossing, both embossing patterns interact like seamlessly and gaplessly homogeneously jointed intertwining structures to emboss the metallized foil such that each of the projections on each roll becomes surrounded on all sides by projections of the other roll. However, in contrast to the prior art technology, where the optical reflective effect produced by the embossed product is a shading effect that darkens the embossed product being viewed, i.e., less light amplitude is reflected at a determined viewing angle, the present invention aims not only to produce a shading effect but also an angle dependent adjustment of reflected light intensity.

Further, it is an aim of the invention to also provide a solution for fine embossing that allows to produce checkered-style and larger uniformly embossed areas in a step length of about 50 to 250 μm, the reflectivity of the embossed foil side of which may theoretically reach the same value as that of a blank mirroring surface of the foil.

Further, it is an aim of the invention to provide a configuration, which also reduces uncontrollable contraction in the axial direction while foils are being embossed.

Further, it is an aim of the invention to provide a solution that allows producing the fine embossing over areas in a homogeneous manner on the foil.

Further, it is an aim of the invention, in contrast to EP 1 324 877 B1 where the illuminating intensity may only be reflected as a beam diminished in intensity, to enable sharply adjustable reflection angles to produce new esthetic effects with the embossed foils.

SUMMARY OF INVENTION

In a first aspect, the invention provides a method of embossing individually light reflecting areas on a foil material, the method comprising feeding a foil material into a roller nip between a pair of rollers, wherein the pair of rollers comprises a motor roller and a counter roller, providing each of the motor roller and counter roller at least in a determined perimeter with a plurality of positive and negative projections on a checkered layout whereby positive and negative projections alternate in axial and radial directions. The positive projections of the motor roller together with alternating corresponding negative projections on the counter roller form during the operation of the rollers and in the roller nip, a first straight line substantially parallel to the axial direction. The negative projections of the motor roller together with alternating corresponding positive projections on the counter roller forming during the operation of the rollers and in the roller nip, a second straight line substantially parallel to the axial direction. Each positive projection extends from a base surface of its roller to a top side of the positive projection in a direction away from a rotation axis of its roller, and each negative projection extends from the base surface of its roller to a bottom side of the negative projection in a direction towards the rotation axis of its roller. During an embossing operation of the motor roller and the counter roller and in the roller nip, each projection of the motor roller is surrounded on all lateral sides by projections of the counter roller. On a roller each positive or negative projection not situated at the determined perimeter, is axially offset relative to the peripherally adjacent positive or negative projections respectively on the same roller. The method further comprises that the plurality of positive and negative projections of the counter roller seamlessly and gaplessly join with those corresponding negative and positive projections of the motor roller at the intended embossing of the foil material, hence enabling a homogeneously jointed embossed polyhedron shape in the foil, and shaping each positive and negative projection on the motor roller as an n-cornered polyhedron with a specific surface intended to produce on the embossed foil surface a corresponding individually light reflecting area, for each positive projection its specific surface corresponding to its top side, and for each negative projection its specific surface corresponding to its bottom side.

In a preferred embodiment, in the step of shaping, for the positive projections, the specific surfaces at the top sides belong to a first set of a plurality of specific surfaces, each of the specific surfaces intended to produce on the embossed foil surface a corresponding individually light reflecting area reflecting in respective different directions, and similarly for the negative projections the specific surfaces of the bottom sides belong to a second set of a plurality of specific surfaces, each of the specific surfaces intended to produce on the embossed foil surface a corresponding individually light reflecting area reflecting in respective different directions.

In a further preferred embodiment, in the step of shaping, for the positive projections, the specific surface extends down to the roller surface.

In a further preferred embodiment, the motor roller and the counter roller comprise steel, and are removably mounted in an interchangeable unit of an embossing system.

In a further preferred embodiment, the motor roller transmits its drive to the counter roller by means of toothed wheels.

In a further preferred embodiment, the method further comprises selecting a first set of side surfaces of the n-cornered polyhedron structures, that each extends from a bottom side of a negative projection to a top side of a positive projection, and are each parallel to each other and to a first plane, and engraving each of the side surface of the first set in a similar manner with a first light-diffusing element.

In a further preferred embodiment, the method further comprises selecting a second set of side surfaces of the n-cornered polyhedron structures, that each extends from a bottom side of a negative projection to a top side of a positive projection, and are each parallel to each other and to a second plane, whereby the second plane intersects with the first plane, and engraving each of the side surface of the second set in a similar manner with a second light-diffusing element.

In a further preferred embodiment, the first set of side surfaces is representative of a first pattern, and the second set of side surfaces representative of a second pattern, whereby when the embossed foil material is illuminated in a determined first angle and viewed in a corresponding second angle, an first image of the first pattern may be viewed, and when the embossed foil material is illuminated in a determined third angle distinct from the first angle, and viewed in a corresponding fourth angle, a second image of the second pattern may be viewed.

In a second aspect, the invention provides a roller stand for embossing individually light reflecting areas on a foil material, comprising a pair of a first roller and a second roller defining a roller nip within which said material is adapted to be fed, each roller being provided at least in a determined perimeter with a plurality of positive and negative projections on a checkered layout whereby positive and negative projections alternate in axial and radial directions. The positive projections of the motor roller together with alternating corresponding negative projections on the counter roller form during the operation of the rolls and in the roller nip, a first straight line substantially parallel to the axial direction, and the negative projections of the motor roller together with alternating corresponding positive projections on the counter roller forming during the operation of the rollers and in the roller nip, a second straight line substantially parallel to the axial direction. Each positive projection extends from a base surface of its roller to a top side of the positive projection in a direction away from a rotation axis of its roller, and each negative projection extends from the base surface of its roller to a bottom side of the negative projection in a direction towards the rotation axis of its roller. During an embossing operation of the motor roller and the counter roller and in the roller nip, each projection of the motor roller is surrounded on all lateral sides by projections of the counter roller. On a roller each positive or negative projection not situated at the determined perimeter, is axially offset relative to the peripherally adjacent positive or negative projections respectively on the same roller. Further the plurality of positive and negative projections of the counter roller seamlessly and gaplessly join with those corresponding negative and positive projections of the motor roller at the intended embossing of the foil material, hence enabling a homogeneously jointed embossed polyhedron shape in the foil. Each positive and negative projection on the motor roller is shaped as an n-cornered polyhedron with a specific surface intended to produce on the embossed foil surface a corresponding individually light reflecting area, for each positive projection its specific surface corresponding to its top side, and for each negative projection its specific surface corresponding to its bottom side.

BRIEF DESCRIPTION OF THE FIGURES

The invention will be understood better through the description of preferred embodiments, and in light of the drawings, wherein.

DESCRIPTION OF PREFERRED EMBODIMENTS OF THE INVENTION

Figure 1A:
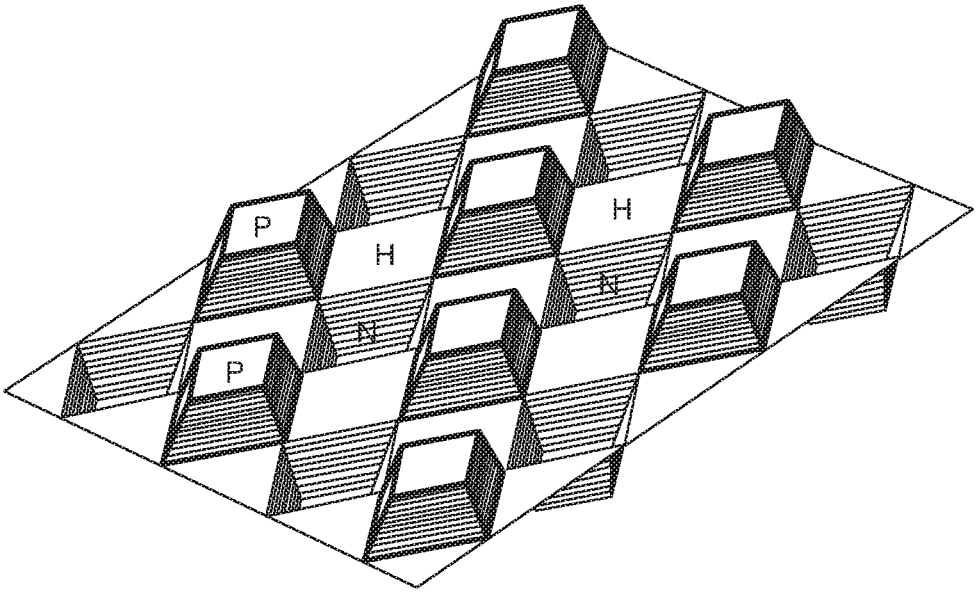
FIG.1a (prior art)
FIG. 1 illustrates an embossing pattern for textiles from prior art, wherein the edges come into contact, but not the side surfaces.
Figure 2A:
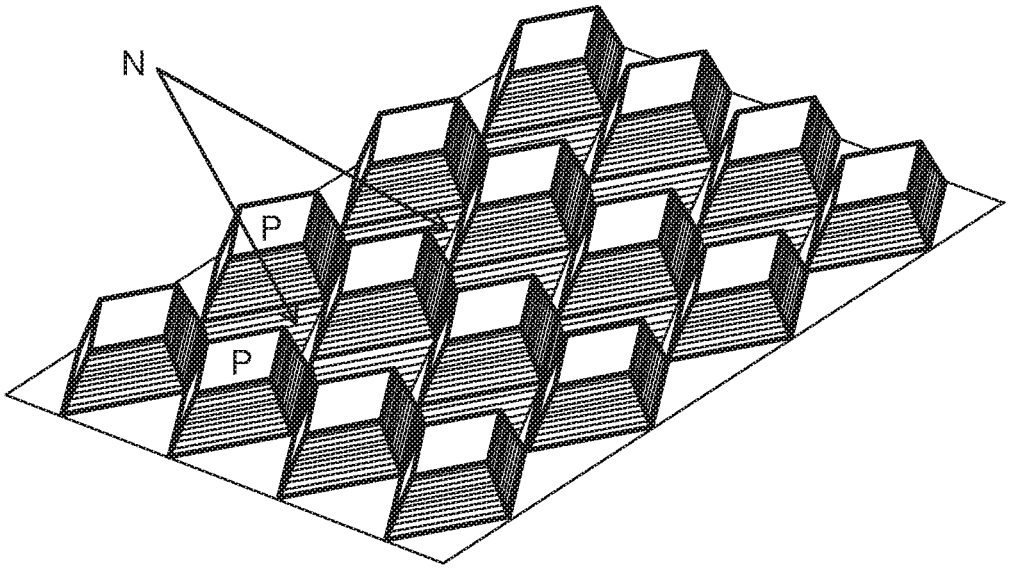
FIGS. 2*a* and 2*b* show a checkered embossing pattern and a layout plan of projections of the checkered pattern, according to prior art, wherein at the time of embossing the surfaces of structures of two rollers—not shown in the figures—using this pattern, come into contact at the time of embossing.
Figure 2B:
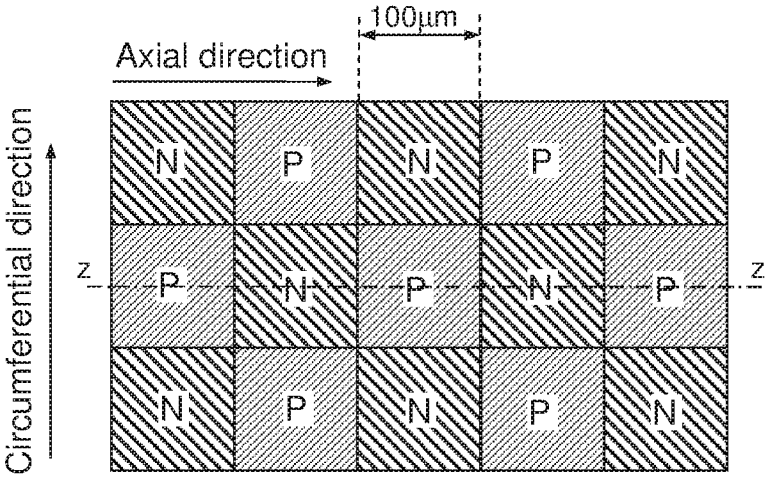
Figure 3:
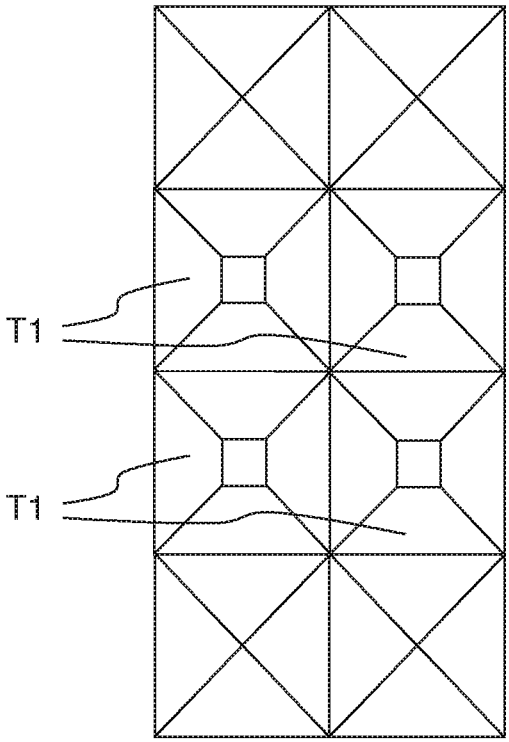
FIG. 3 shows an example of teeth seen from above, and used for satinizing, as known from prior art.
Figure 4:
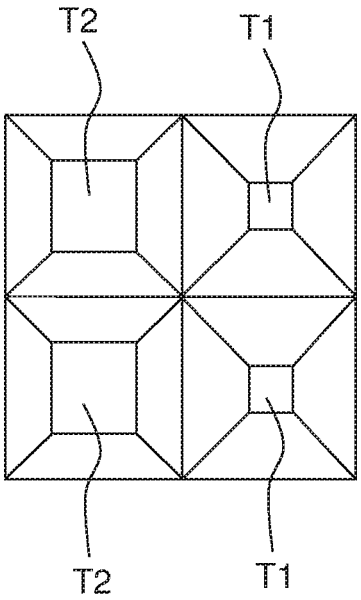
FIG. 4 shows an example of teeth seen from above, and used for creating shading effects according to prior art.
Figure 5:
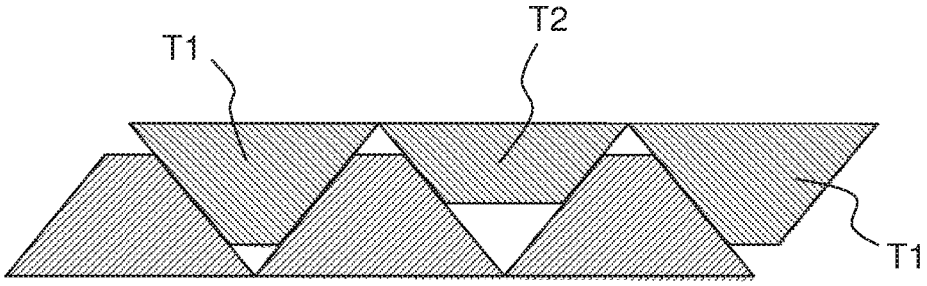
FIG.5 (prior art)
FIG. 5 show a sectional view of teeth from FIGS. 3 and 4, when those teeth are intertwined as at the time of embossing, according to prior art.
Figure 6:
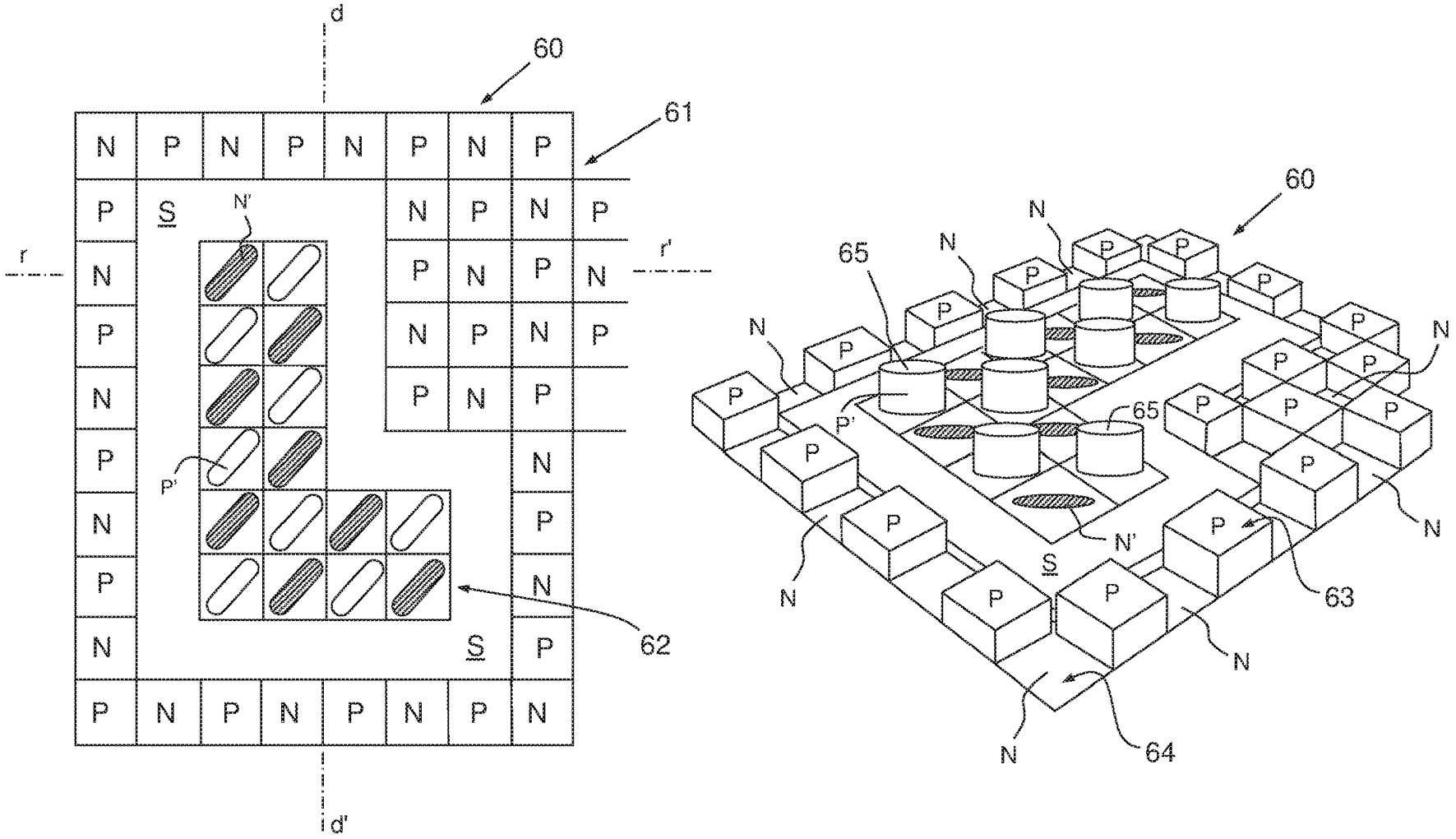
FIG. 6 shows an example embodiment of a roller surface according to the invention, in view from above and in 3-dimensional view.

FIG. 6 shows an example embodiment of a roller surface 60 according to the invention, in an upper view on the left part of FIG. 6, and in a 3-dimensional perspective view on the right-side part of FIG. 6. The roller surface 60 is flattened out in FIG. 6 for an easier reading, but on the roller (not shown in FIG. 6) the roller surface 60 is curved and oriented along an axial direction represented as an axis d-d' on the left side of FIG. 6. The roller surface 60 as illustrated may be only a part of the actual complete surface, the complete surface not being shown in FIG. 6.

The roller surface 60 may be located on a motor roll, which cooperates with a counter roll to emboss a foil material that is fed into a roll nip between the motor roll and the counter roll (not shown in FIG. 6).

The roller surface 60 comprises a plurality of positive projections P and P', and negative projections N and N'. The positive projections P and negative projections N are laid out in a first checkered layout 61 whereby positive and negative projections alternate in axial direction d-d' and radial direction r-r'. Similarly, the positive projections P' and the negative projection N' are in a second checkered layout 62 whereby positive and negative projections alternate in axial direction d-d' and radial direction r-r'.

The first checkered layout 61 is delimited partly by a substantially flat surface S, which is surrounded by positive projections P and negative projections N. The surface S is empty of any positive projections P and negative projections N, and at a time of embossing with a counter roller (not shown in FIG. 6) produces no embossing of the foil material. The first checkered layout 61 may extend on a side going away from the surface S, either to a determined perimeter in axial and/or radial direction, whereby the determined perimeter could be a greater shape surface representing for example a logo (not shown in FIG. 6). Alternatively the first checkered layout 61 may also extend in radial direction r and opposite axial direction r' until it covers the whole periphery of the motor roller. The first checkered layout 61 may also extend in axial directions d and/or d' until it reaches either axial extremity of the motor roller (not represented in FIG. 6) depending on the desired design to emboss on the foil material.

The second checkered layout 62 is delimited by an L-shaped perimeter, which for sakes of an example is 6 projections high in axial direction d-d' and 4 projections wide in radial direction r-r', each bar of the L-shape being 2 projections wide. The L-shaped perimeter is surrounded by the surface S.

For each respective first and second checkered layouts 61 and 62, the positive projections P and P' of the motor roll form with alternating corresponding negative projections on the counter roller (not shown in FIG. 6) during operation of the rolls and in the roll nip, respective straight lines substantially parallel to the axial direction d-d'.

Similarly for each respective first and second checkered layouts 61 and 62, the negative projections N and N' of the motor roll form with alternating corresponding positive projections of the counter roller (not shown in FIG. 6) during operation of the rolls and in the roll nip, respective straight lines substantially parallel to the axial direction r-r'.

Each positive projection P extends from a base surface of the motor roll—which in FIG. 6, and as can be better seen on the right hand part of the figure, corresponds to surface 64 underlying the blocks P and covering the blocks N, this surface lying under the surface S for this particular exemplary embodiment—to a top side 63 of the positive projection P in a direction away from a rotation axis of the motor roll (not represented in FIG. 6). Each negative projection N extends from the base surface of the motor roll to a bottom side of the negative projection (not visible in FIG. 6) in a direction towards the rotation axis of the motor roll.

Similarly each positive projection P' extends from a base surface of the motor roll—which in FIG. 6, and as can be better seen on the right hand part of the figure, corresponds to the surface S—to a top side 65 of the positive projection P' in a direction away from a rotation axis of the motor roll (not represented in FIG. 6). Each negative projection N' extends from the base surface of the motor roll to a bottom side of the negative projection (not visible in FIG. 6) in a direction towards the rotation axis of the motor roll.

In FIG. 6, the shape of the positive projections P and negative projections N is represented in a generic manner as a block with rectangular side. For actual embossing projections, the shape will be made to satisfy the desired esthetic result, and may be a n-cornered polyhedron with a specific surface intended to produce on the embossed foil surface (not shown in FIG. 6) a corresponding individually light reflecting area, for each positive projection its specific surface corresponding to its top side, and for each negative projection its specific surface corresponding to its bottom side.

While the shape of the positive projections P' is shaped as a pillar with oval circumference, this is also not an actual shape envisaged, but only a generic shape, the pillar being selected only to differentiate from the positive projection P, and indicated that the shape of the positive projections P' may be different from the shape of the positive projections P. In other words, the shape of the positive projections P' may be a n-cornered polyhedron—same or different as positive projection P—with its specific surface intended to produce on the embossed foil surface (not shown in FIG. 6) a corresponding individually light reflecting area, for each positive projection P' its specific surface corresponding to its top side, and for each negative projection N' its specific surface corresponding to its bottom side (not shown in FIG. 6). The structure oval surface labeled N' correspond to the base of the negative projections N' in FIG. 6, the actual extend of the projection not being visible, as it is directed into the surface of the motor roller (not represented in FIG. 6).

An order of magnitude for the structures in the embossing pattern of FIG. 6, e.g., a size of the surface containing one of the generic positive projections P or negative projections N, lies around 100×100 $\mu m^2$. The exact dimensions are irrelevant for the present explanation; it is only intended to indicate an order of magnitude for the size of the projections in the invention.

Figure 7A:
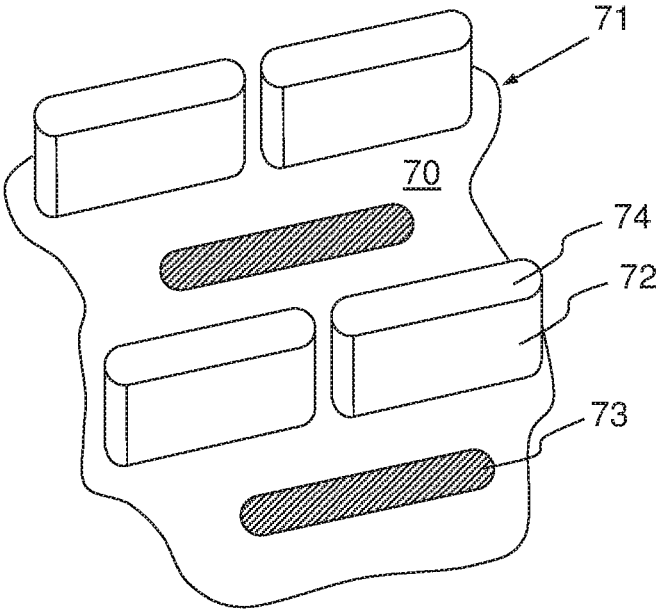
FIG. 7 shows in its' upper part (a) a small surface of an example of a foil embossed using the embossing structures illustrated in FIG. 6, and in its lower part (b) illustrates optical reflection at the embossed structures.
Figure 7B:
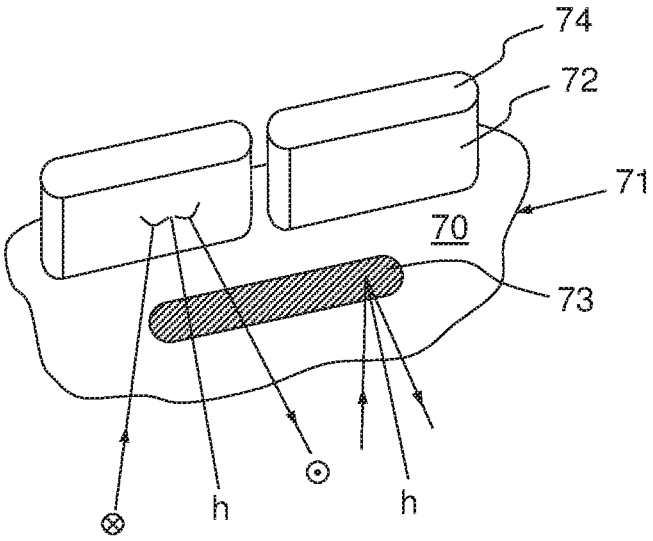

FIG. 7(*a*) shows a partial surface of an example foil material 71 embossed using the embossing structure 60 illustrated in FIG. 6, more particularly positive projections P' and negative projections N' from the second checkered layout 62—which of course are not illustrated in FIG. 7(*a*). A surface 70 of the foil material 71 comprises embossings 72 resulting from the cooperation of positive projections P' of the motor roller and corresponding negative projections of the counter roller. The surface 70 further comprises embossings 73—which are represented only by an embossed opening of a cavity at the surface 70, the actual structure extending under the surface 70 as represented in FIG. 7(*a*)—resulting from the cooperation of negative projections N' of the motor roller and corresponding positive projections of the counter roller. The shape of the embossed structures 72 and 73 correspond to that of the positive and negative projections—P' and N'—from FIG. 6, and thus are represented here only with a generic shape which is not representative of actual shapes claimed for the invention. As explained in the context of FIG. 6, the actual shapes rather correspond to an n-cornered polyhedron.

Also represented in a generic manner in FIG. 7(*a*) are the embossed specific surfaces 74, resulting from embossing the specific surface 65 of positive projections P'. It is noted that as the surfaces 74 are only represented in a generic manner, it may not be parallel to the surface 70, but rather in an angle differing from it being parallel to this surface 70. Specific surfaces for the negative projections resulting in the embossed structures 73 are not visible in FIG. 7(*a*) as they are located at a bottom of the embossed structure 73, shaped as cavities, below the surface 70.

FIG. 7(*b*) illustrates and even smaller partial surface of the example foil material 71, with 2 embossed structures 72 resulting from embossing the positive projections P', and 1 embossed structure 73 resulting from embossing the negative projection N'. The 2 embossed structures 72 have at their top side embossed specific surfaces 74 which are intended to reflect light incident on the foil material. The embossed structure 73 has at its bottom side an embossed specific surface which is intended to reflect light incident on the foil material—albeit this specific surface is not visible in FIG. 7(*b*). FIG. 7(*b*) illustrates the principle of optical reflection at the surface of the embossed structures 72, whereby the law of reflection applies relative to the perpendicular h taken from the surface, but also for the specific surface at the bottom of embossed structure 73. A slight tilt of the structures and/or foil actually makes the surfaces from embossed structures 72 and those specific surfaces of the embossed structures 73 reflect light as appropriate. The non-embossed free surface 70 just produces an effect of deepness.

The specific surfaces are light reflecting areas of the embossed foil material intended to reflect light incident. This is a property of the embossed structures, resulting from the shape of the n-cornered polyhedrons, which is not explicitly illustrated in FIGS. 6, 7(*a*) and 7(*b*) as these only represent generic structures as placeholders to actual structure according to the invention. In addition FIG. 7(*b*) actually only illustrates reflection for a light beam entering at an angle chosen as an example only.

Figure 8A:
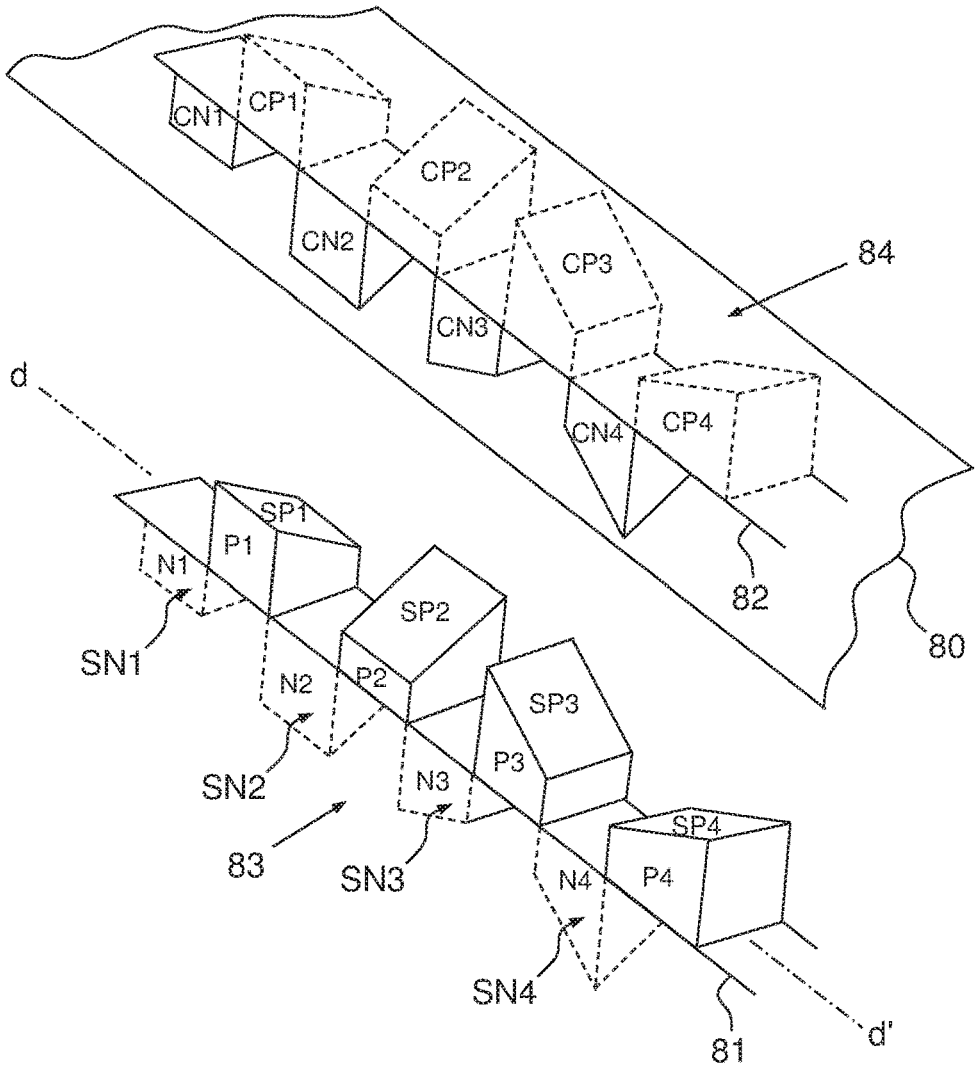
FIG. 8*a* schematically illustrates an example according to the invention, of corresponding embossing structures from a roller and a counter roller, which may be used to emboss structures that produce a shading in radial directions.
Figure 8B:
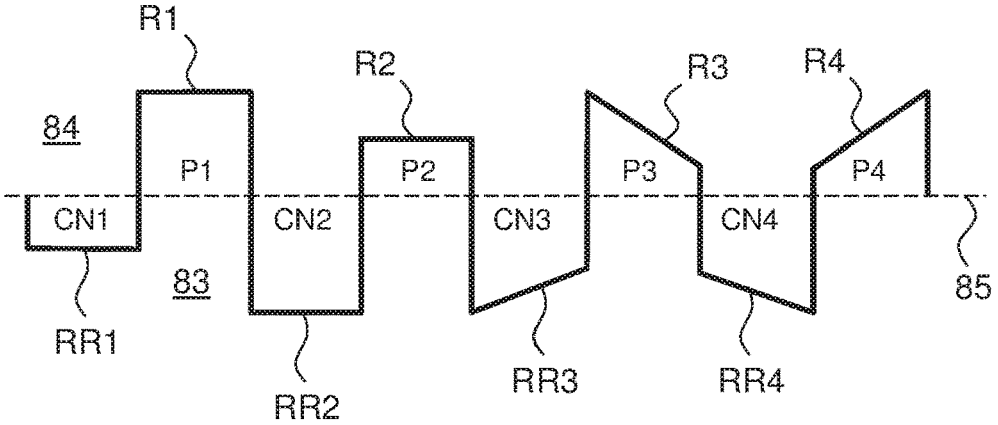
FIG. 8*b* shows embossed shapes in a foil material during embossing in a sectional view.

FIG. 8(*a*) schematically illustrates an example according to the invention, of corresponding embossing structures from a motor roller 83 and a counter roller 84, which may be used to emboss structures N1, P1, N2, P2, N3, P3, N4, P4 in a foil material 80, whereby resulting embossed structures in the material foil produce a shading in radial directions when light is projected towards the embossed foil material 80 (shading not illustrated in FIG. 8(*a*). The embossing structures have an n-cornered polyhedron shape.

On the motor roller 83, a series of positive projections P1, P2, P4, P4 alternate with a series of negative projections N1, N2, N3, N4, all negative and positive projections being aligned according to axial direction d-d'. The positive projections P1, P2, P3, and P4 comprise specific surfaces SP1, SP2, SP3, and SP4 at their top side intended to emboss light reflecting surfaces R1, R2, R3, R4 in the foil material 80, as shown in the sectional view of embossed foil material 80 in FIG. 8(*b*). Similarly, the negative projections N1, N2, N3, and N4 comprise specific surfaces SN1, SN2, SN3, and SN4 at the bottom side intended to emboss light reflecting surfaces RR1, RR2, RR3, and RR4 in the foil material 80, as shown in the sectional view of embossed foil material 80 in FIG. 8(*b*).

The counter roller 84 comprises negative projections CP1, CP2, CP3, CP4 corresponding to positive projections P1, P2, P3, P4 respectively, and positive projections CN1, CN2, CN3, CN4 corresponding to negative projections N1, N2, N3, N4 respectively.

The motor roller 83 and the counter roller 84 are illustrated separated at a distance with a foil material 80 to be embossed between the two rollers. At the time of embossing the motor roller 83 and the counter roller 84 are moved towards each other, forming a roll nip—not shown in FIG. 8(*a*)—in which foil material 80 may be fed. The negative and positive projections from motor roller 83 intertwine respectively with the positive and negative projections from counter roller 84, in order to emboss structures corresponding to the projections into the foil material 80. At the time of embossing, the plurality of positive and negative projections of the counter roller seamlessly and gaplessly join with those corresponding negative and positive projections of the motor roller, hence enabling a homogeneously jointed embossed polyhedron shape in the foil material 80.

FIG. 8(*b*) shows embossed shapes from positive projections P1, P2, P3, P4 and negative projections N1, N2, N3, N4, i.e., positive projections CN1, CN2, CN3, CN4, in the foil material 80 during embossing in a sectional view according to line 81 and 82 represented in FIG. 8(*a*). The foil material 80 is represented using a bold line representing a thickness of the foil material 80. A dotted line 85 represents a mean base surface level of the motor roller 83 and counter roller 84 across all projections.

In a particular embodiment, in which the specific light reflecting surfaces R1, R2, R3, R4, RR1, RR2, RR3, RR4 have an angle of 45° with the mean surface of the embossed foil material, light incident along the first direction perpendicular to the foil material is reflected in a direction parallel to the embossed foil material mean surface (not illustrated in FIGS. 8(*a*) and 8(*b*)).

Figure 9:
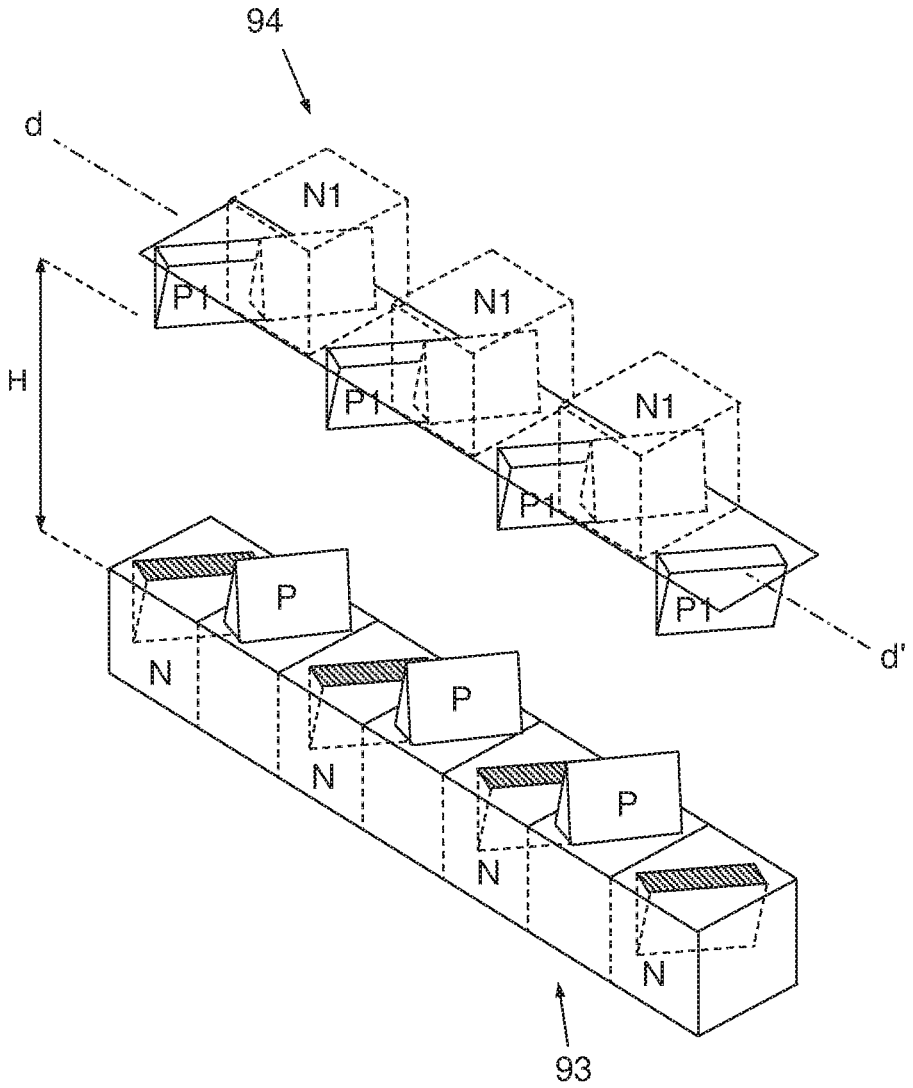
FIG. 9 schematically illustrates a further example according to the invention of corresponding embossing structures from a roller and a counter roller, which may produce a shading in a single radial direction.

FIG. 9 schematically illustrates a further example according to the invention of corresponding embossing structures from a motor roller 93 and a counter roller 94, which may produce a shading in a single radial direction when light is projected to and reflected from foil material embossed therewith, and more precisely reflected from individually light reflecting areas obtained with embossing structures (foil material not illustrated in FIG. 9). The motor roller 93 comprises on its surface negative projections N in the shape of an n-cornered polyhedron, more precisely wedge shaped projections N penetrating into the surface of the motor roller 93. It is noteworthy that in this example, the specific surfaces intended to emboss the individually light reflecting areas extend from the utmost bottom of the projection to the roller surface. The motor roller further comprises positive projections P, that alternate with the negative projections N, and form a checkered layout—only one row of which is illustrated in FIG. 9—whereby the projections are aligned in axial direction d-d'. The positive projections P protrude from the motor roller's 93 means surface.

FIG. 9 further shows a corresponding layout of positive and negative projections P1 and N1 on the counter roller 93, positioned and dimensioned such that at the time of feeding foil material to be embossed in a roller nip formed by both the motor roller 93 and counter roller 94 (foil material and roller nip not shown in FIG. 9), the plurality of positive and negative projections P1, N1 of the counter roller 94 seamlessly and gaplessly join with those corresponding negative N and positive P projections of the motor roll 93, hence enabling a homogeneously jointed polyhedron shape in the foil material.

Figure 10:
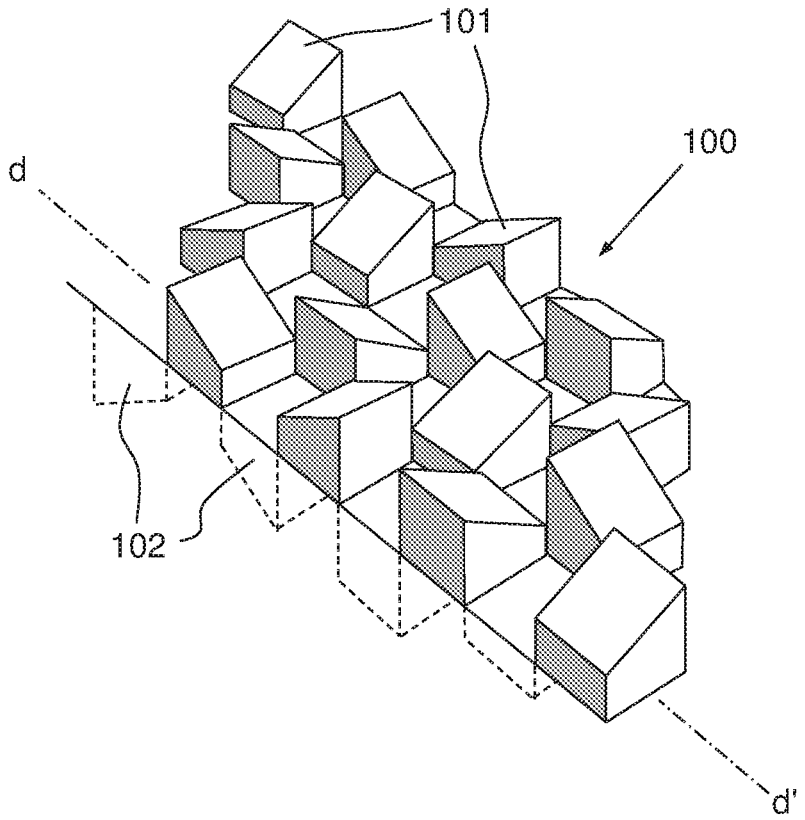
FIG. 10 shows a piece of embossed foil product, embossed using embossing structures shown in FIG. 8.

FIG. 10 shows a piece of embossed foil material 100, embossed using embossing structures similar to those shown in FIG. 8(*a*). The embossed structures comprise projections 101 showing upwards in the drawing of FIG. 10, and projections 102 showing downwards, below the surface of the foil material as illustrated in FIG. 10. An axis d-d' corresponds to an axial axis of embossing rollers used to emboss the foil material—rollers not shown in FIG. 10.

Figure 11A:
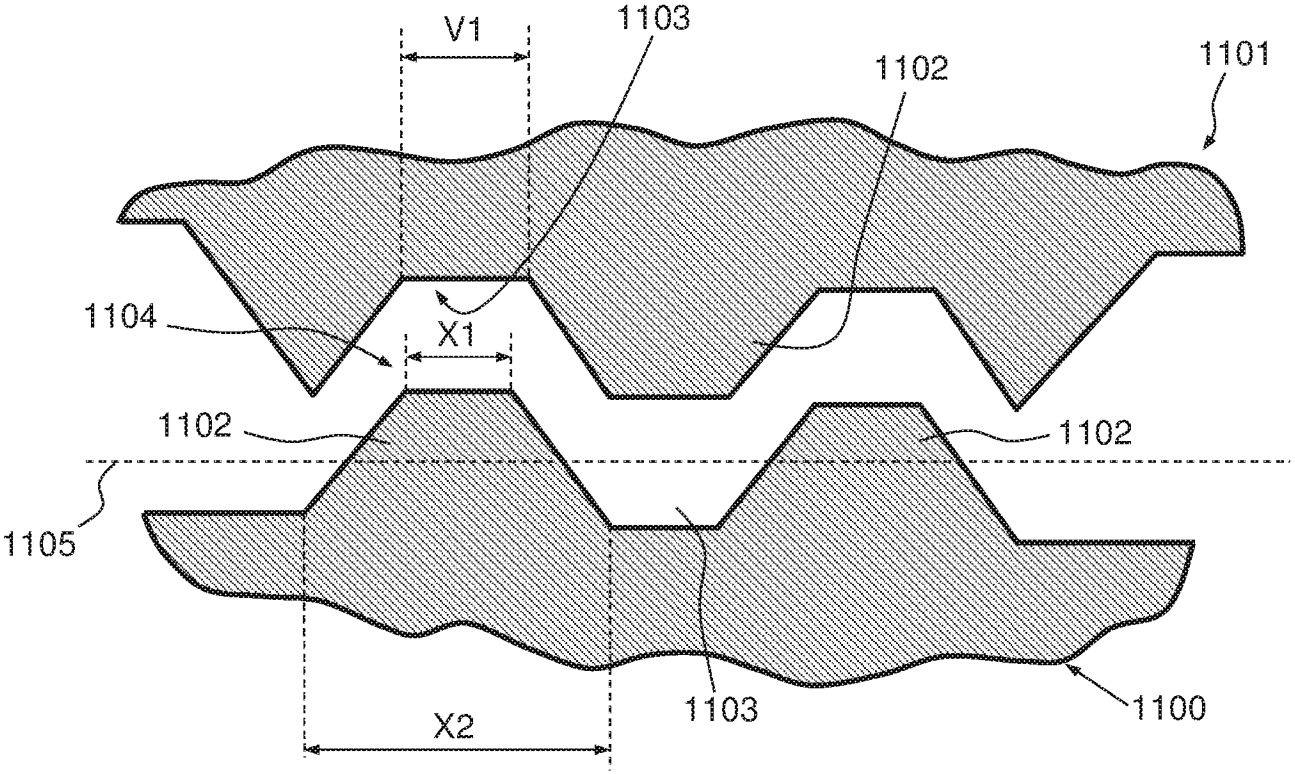
FIGS. 11*a* and 11*b* show a preferred embodiment for embossing structures according to the invention.
Figure 11B:
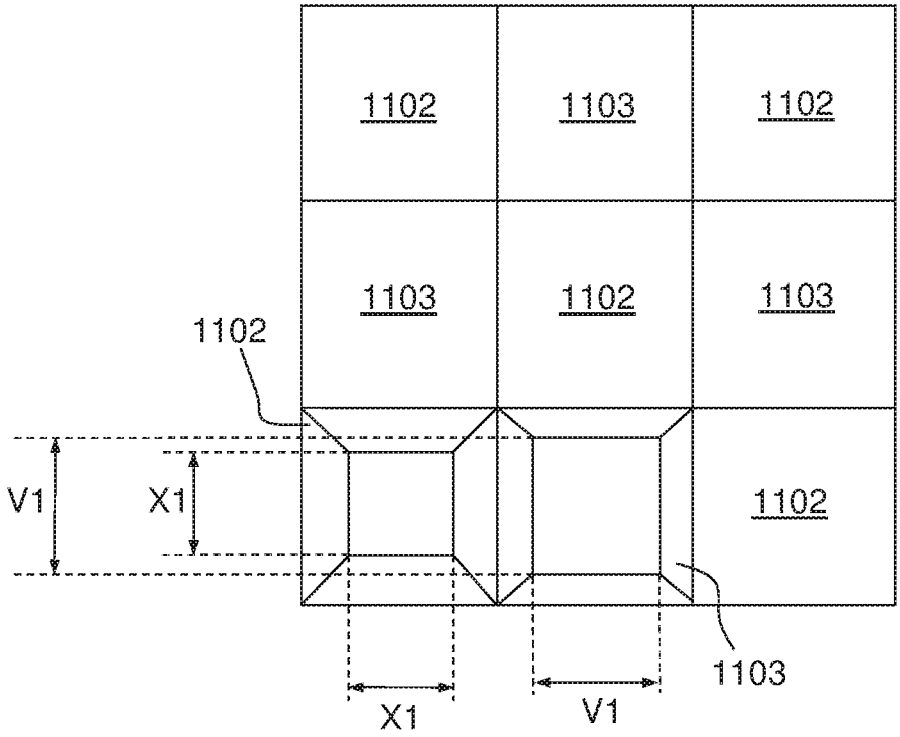

FIGS. 11(*a*) and 11(*b*) show a preferred embodiment for embossing structures according to the invention. FIG. 11(*a*) shows a sectional view through a motor roller 1100 and its counter roller 1101, the two rollers being position such that positive projections 1102 from the motor roller 1100 are positioned for embossing in front of negative projections 1103 of the counter roller 1101, and negative projections 1103 from the motor roller 1100 are positioned for embossing in front of positive projection 1103 of the counter roller 1101. In the illustration of FIG. 11(*a*) the distance 1104 between the motor roller 1100 and the counter roller 1101 is filled with the foil material being embossed, hinting a finite thickness of the foil material being embossed. The specific surfaces of the positive projections 1102 are squares with a side length X1, while the specific surfaces of the negative projections 1103 are squares with a side length V1, whereby X1<V1. The value of X1 is deliberately made inferior to the value of V1 to take into account the thickness of the foil material and achieve a seamless and gapless joint of the projections from the motor roller 1100 with the projection from the counter roller 1101.

FIG. 11(*a*) further shows a mean level of the surface of the motor roller 1100 by means of dotted line 1105. The height of a positive projection 1102 measured from this dotted line 1105 is the same as the depth of a negative projection 1103 measured from this dotted line 1105. The sum of the height and depth indicated herein is typically in the order of 40 μm, which is similar to the uncompressed thickness of the foil material to be embossed.

A distance separating two specific surfaces of negative projections 1103 is indicated by X2.

FIG. 11(*b*) shows an upper view of a checkered layout of positive and negative projections 1102 and 1103 on the motor roller surface. For a better readability of the figure, only 1 each of positive and negative projections is illustrated with their respective specific surface, i.e., a square surface with side value X1 and V1 respectively.

As a result of the embossing with the embossing structures of FIGS. 11(*a*) and 11(*b*), the embossed foils material comprises pyramidal structures, the top of which is truncated. Hence, light projected on a surface containing such embossed structures would typically reflect a lesser intensity of light than a surface embossed with complete pyramidal structures.

Figure 12:
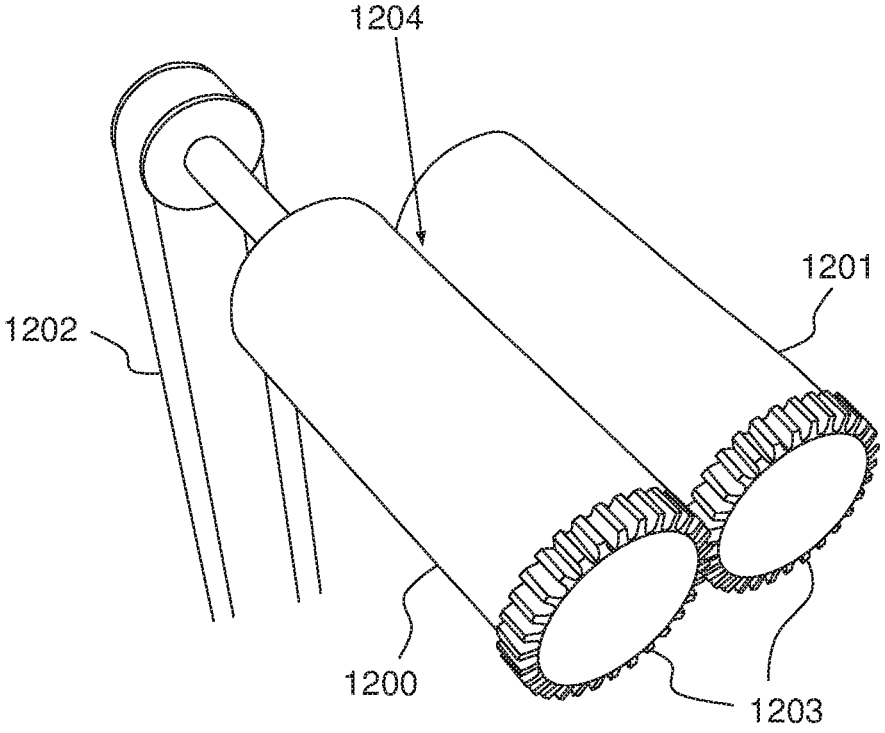
FIG. 12 illustrates an example embossing system for implementing the embossing with the embossing structures according to the invention.

FIG. 12 illustrates an example embodiment of an apparatus for embossing foil material on both sides according to the invention (foil material not represented in FIG. 12). The apparatus comprises a pair of a first roller 1200 and a second roller 1201, whereby the first roller 1200 is driven by means of a drive mechanism 1202, and transmits the drive force to the second roller 1201 by means of toothed wheels 1203, located at an extremity of each roller. The type of drive mechanism 1202 and structure of the toothed wheels 1203 to transmit the drive force are exemplary only and may be varied while remaining in the scope of the present invention. It may for example be that no toothed wheels are used, and that the drive is realized by the interactions of the projections of both embossing rollers with each other (not shown in FIG. 12). The foil material to be embossed on both of its sides (foil material not shown in FIG. 12), is intended to be inserted in a roll nip 1204. The surfaces of the first roller 1200 and the second roller 1202 are equipped with embossing structures as explained in the present description, as for example the embodiment shown in FIG. 6 for the first roller 1200, and a corresponding opposite structure for the second roller 1202.

The first roller 1200 and the second roller 1201 may comprise steel, and may be removably mounted in an interchangeable unit of an embossing system.

Figure 13:
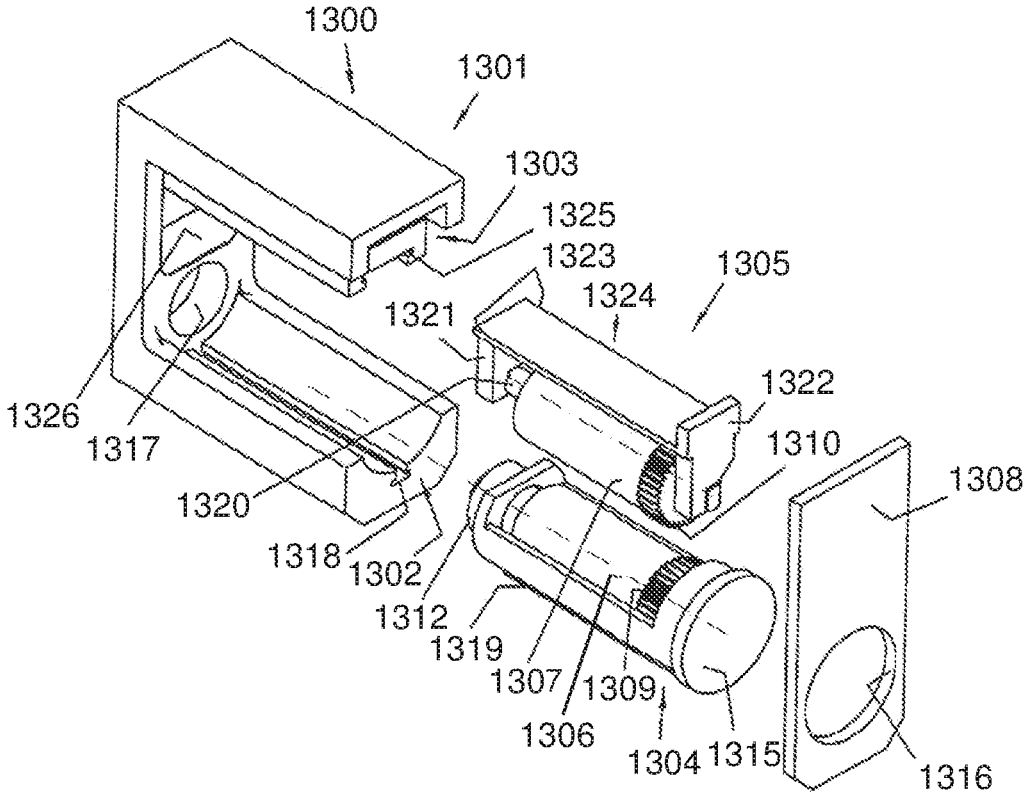
FIG. 13 illustrates a further example embossing system with a quick-change device for rollers in a perspective view.

FIG. 13 illustrates a further example embodiment of an apparatus for embossing foil material on both sides according to the invention (foil material not represented in FIG. 13), in the form of a quick-change device 1300. The quick-change device 1300 includes a housing 1301 with two mountings 1302 and 1303 for receiving a roller carrier 1304 and 1305 each. Roller carrier 1304 serves for fastening the male die roller 1306 which is driven via the drive (not represented in FIG. 13) and roller carrier 1305 serves for fastening the female die roller 1307. The roller 1304 may be pushed into the mounting 1302 and roller carrier 1305 into the mounting 1303. The housing 1301 is closed off with a termination plate 1308.

In the present example, the female die roller is driven by the driven male die roller 1306 in each case via toothed wheels 1309 and 1310, which are located at an end of the rollers. In order to ensure the demanded high precision of synchronization, the toothed wheels are produced very finely. Other synchronization means are also possible, e.g., electric motors.

When pushed into the mountings, a roller axle (not shown in the FIG. 13) of the male die roller 1306 is rotatably held in a needle bearing 1312 in the roller carrier 1304 and on the other side in ball bearing (also not shown in the FIG. 13). The two ends—only one end 1315 is shown in FIG. 13—of the roller carrier 1304 are held in corresponding opening 1316 and 1317 in the housing, or termination plate. For the exact and unambiguous introduction and positioning of the roller carrier into the housing, the housing bottom comprises a T-shaped slot 1318, which corresponds to a T-shaped key 1319 on the roller carrier bottom. The roller axle 1320 of the female die roller 1307 is mounted on one side, in the drawing on the left, in a wall 1321 of the roller carrier 1305 and on the other side in a second wall 1322 of the roller carrier. The edges 1323 of lid 1324 of the roller carrier are embodied as keys which can be pushed into the corresponding T-slot 1325 in the housing 1301. Here, the one sidewall 1321 fits into a corresponding opening 1326 in the housing wall.

Figure 14:
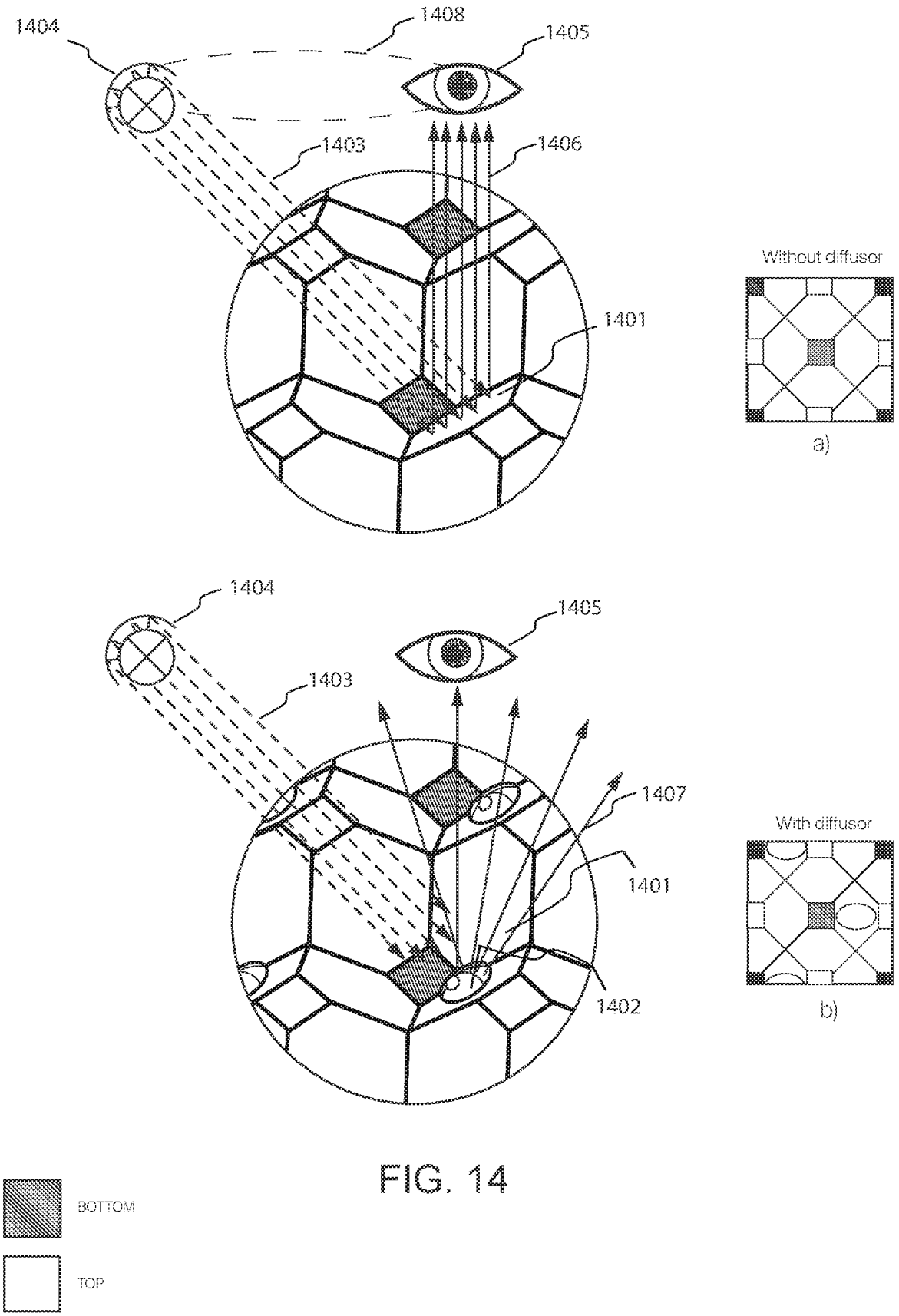
FIGS. 14*a* and 14*b* show two modes of reflection on a polyhedron surface reproduced by embossing a foil: a) directed reflection on plain surface and b) diffuse reflection on surface with diffusor element.

FIGS. 14(*a*) and 14(*b*) show a further preferred example of embossed structures derived from an n-cornered polyhedron shape resulting from embossing tools according to the invention. The left-hand side views of FIGS. 14(*a*) and 14(*b*) are represented in three dimensions, while the right-hand side views are in 2 dimensions. In the embossed structures which result from embossing with a motor roller and a counter roller (not shown in FIGS. 14(*a*) and 14(*b*)), the positive projections have a top side represented by white squares without texture. The negative projections are represented with squares having texture. As shown in FIG. 14(*a*) a lateral side surface 1401 extends on a side of a positive projection and a side of a negative projection connecting a top side to a bottom side.

Figure 15:
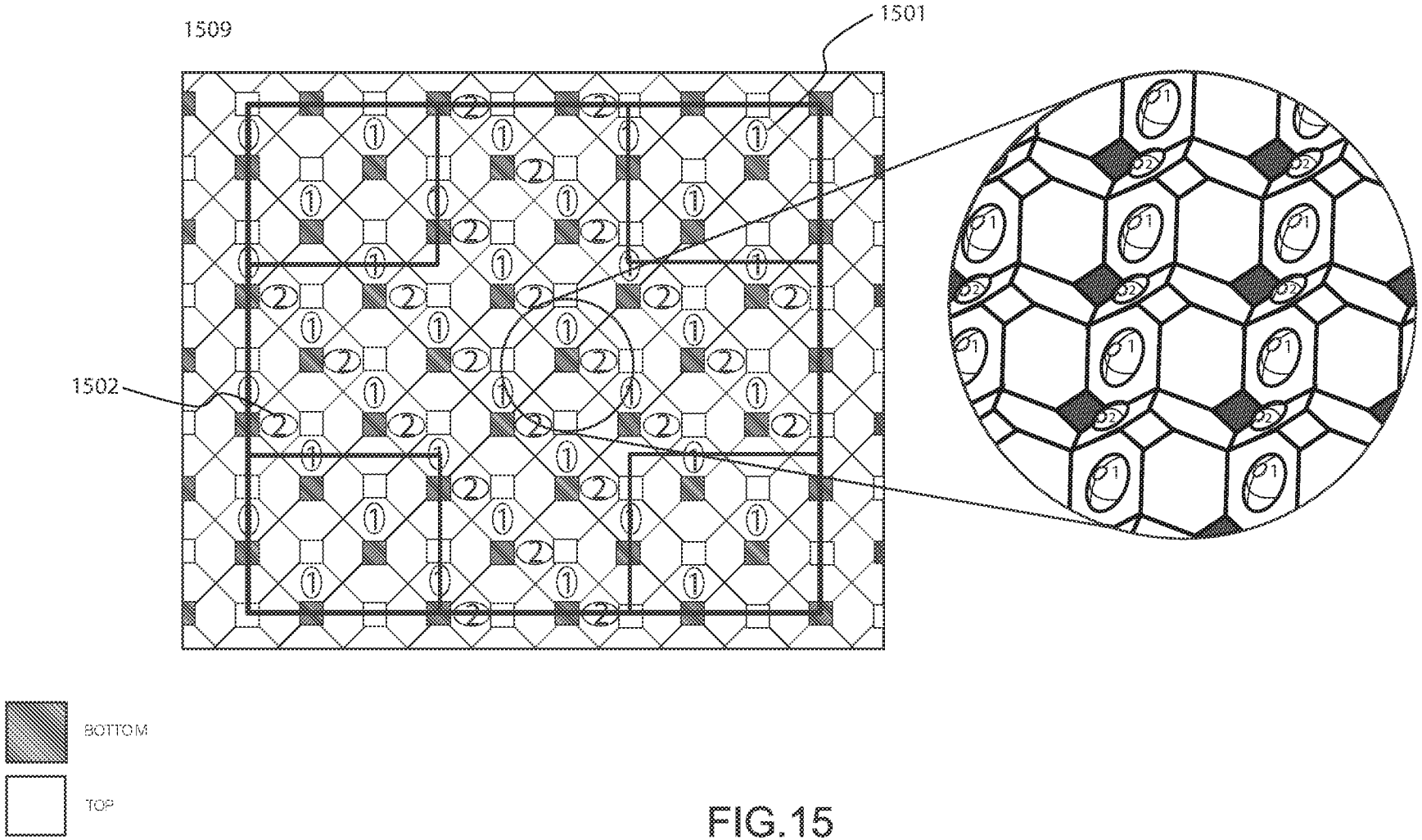
FIG. 15 illustrates an example of creation of a complete image with diffusing elements on polyhedric base structures according to the invention.
Figure 16:
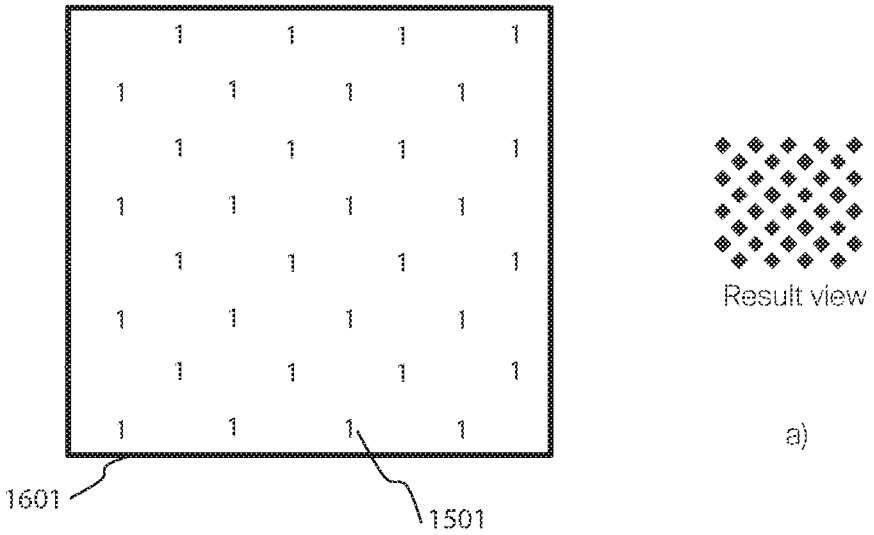
FIG. 16 illustrates map views of a square and a cross that are both reproduced in FIG. 15.
Figure 16:
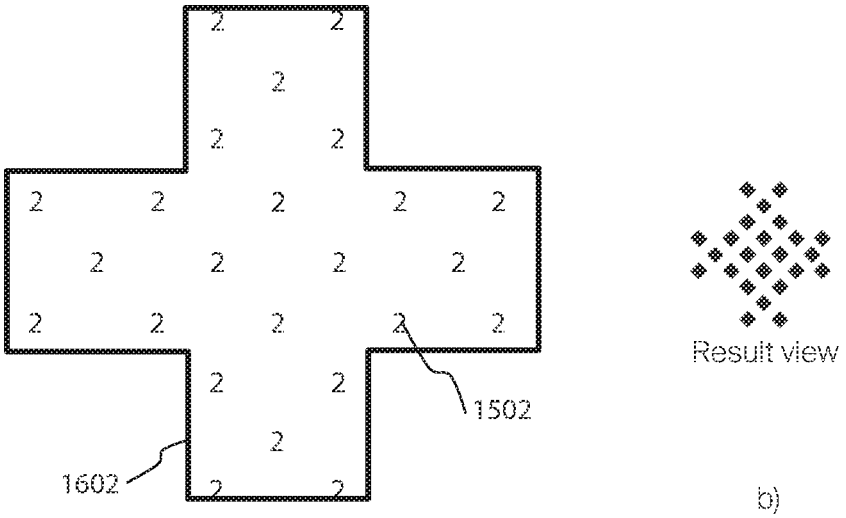

As will be shown through FIGS. 14 to 18, a modulation of a degree of reflectivity of mirroring faces from the embossed structures, e.g., multiple sides 1401 present on the embossed structures, may be used to form an optical reflected image on otherwise uniformly reflecting embossed surfaces 1401 like the one shown in FIG. 14(*a*) by putting together a multitude of modulated degrees of reflectivity of mirroring faces, making use of a light-diffusing surface element 1402 shown in FIG. 14(*b*), into a (regular) array 1509 (see FIG. 15) of light-diffusing elements 1501 and 1502. In FIG. 15, a larger portion of a foil with embossed structures is represented, in a two-dimensional upper view for the left-hand side view, and a 3-dimensional view for the right-hand side view.

Returning now to FIGS. 14(*a*) and 14(*b*), flat faces used to produce the side surface 1401, are part of positive and negative projections that may be found on a patrix/matrix embossing tool (not shown in FIGS. 14(*a*) and 14(*b*)) used to emboss the embossed structures of FIGS. 14(*a*) and 14(*b*). The flat faces may be respectively perturbed by a light-diffusing element such as a convex/concave element or otherwise-formed which may be engraved at a time of production of the patrix/matrix tool itself (not shown in FIGS. 14(*a*) and 14(*b*)). Such convex/concave element or otherwise-formed element is configured to emboss the light-diffusing element 1402, which operates as a light-diffusing irregularity for a beam of directional light 1403 directed on the side 1401 containing the light diffusing element 1402. The height of the aforementioned light-diffusing element may lay in the range of 1-50 μm in practical applications. With reference to the height of for example 50 μm, the optical design of the light-diffusing element may be determined by the requirements of the particularly needed reflection effect, available input intensity, contrast, etc. and is in balance with the perceived light intensity at the human eye, whereby observing the rules of standard geometrical optics design.

When shining the beam of directional light 1403 from a light source 1404 onto the side surface 1401 without any light-diffusing element 1402, as shown in FIG. 14(*a*), the light is directly reflected in reflected light beam 1406 in direction of an intended observer 1405, i.e., the illumination hits an unperturbed surface and the following condition is met: the light source 1404, the observer 1405, the directional illumination 1403 and the reflected light beam 1406 are to be found on a same observation plane 1408. On the other hand, if the directional light 1403 emitted by the light source 1404 hits the light-diffusing element 1402 configured as a diffusor element, as shown in FIG. 14(*b*), the reflected light beam is diffused as shown by arrows 1407 to a high degree and only a very small fraction of light will get back to the observer 1405. A size and shape of the light-diffusing element 1402 may influence a degree of diffusion and hence may be used to modulate the reflectivity into "gray-scale" values. Referring to FIG. 15, a complete reflected image is created by placing a multitude of such single light-diffusing elements 1501 and 1502, similar to the light-diffusing element 1402, in a regular or an irregular pattern of the array 1509 of structures. The image of the complete reflected image may be viewed in a crisp manner only from a single, well-defined direction with a well-defined angle of incidence of the illumination, as illustrated for example in FIGS. 17*a*-17*b*.

By extending light-diffusing elements as discussed in relation to FIGS. 14 and 15, onto several mirroring faces of the elementary embossing structures, a flipping effect of the image may be created. This effect is also well known under the name of Optically Variable Device (OVD). As shown in FIG. 15, the basic elements of a square and a cross respectively 1501 and 1502—also shown schematically and separately in FIG. 16 in a map view for a better understanding, the square being referenced 1601 and the cross 1602—are superimposed onto each other by engraving as appropriate in the embossing tools only the concerned side faces of the structures (embossing tools not shown in FIG. 15). Depending on the illumination and viewing direction (not shown in FIG. 15), either one or the other shape will be visible.

Figure 17:
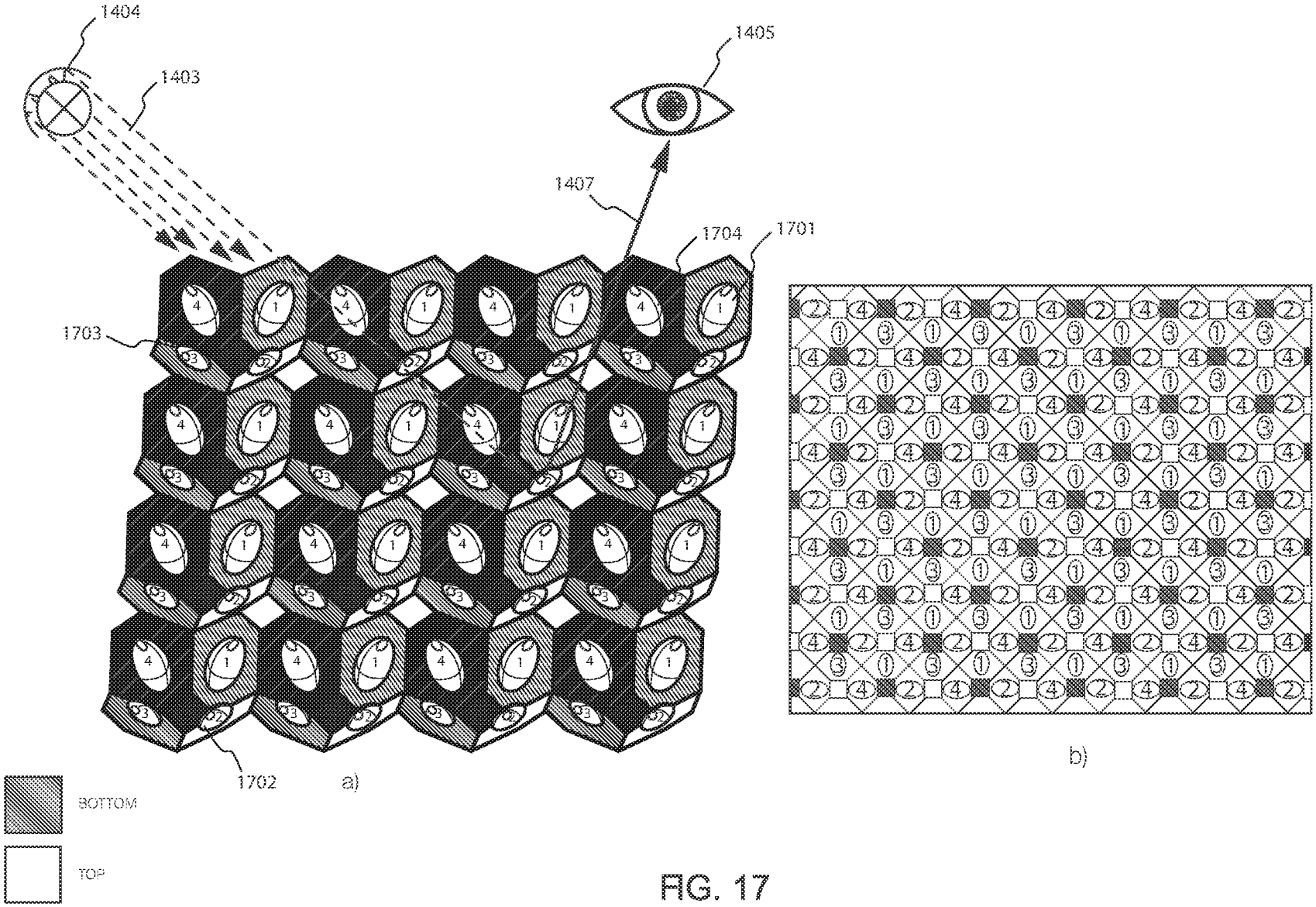
FIG. 17 contains an illustration of example embossed structures in a foil according to the invention.
Figure 18:
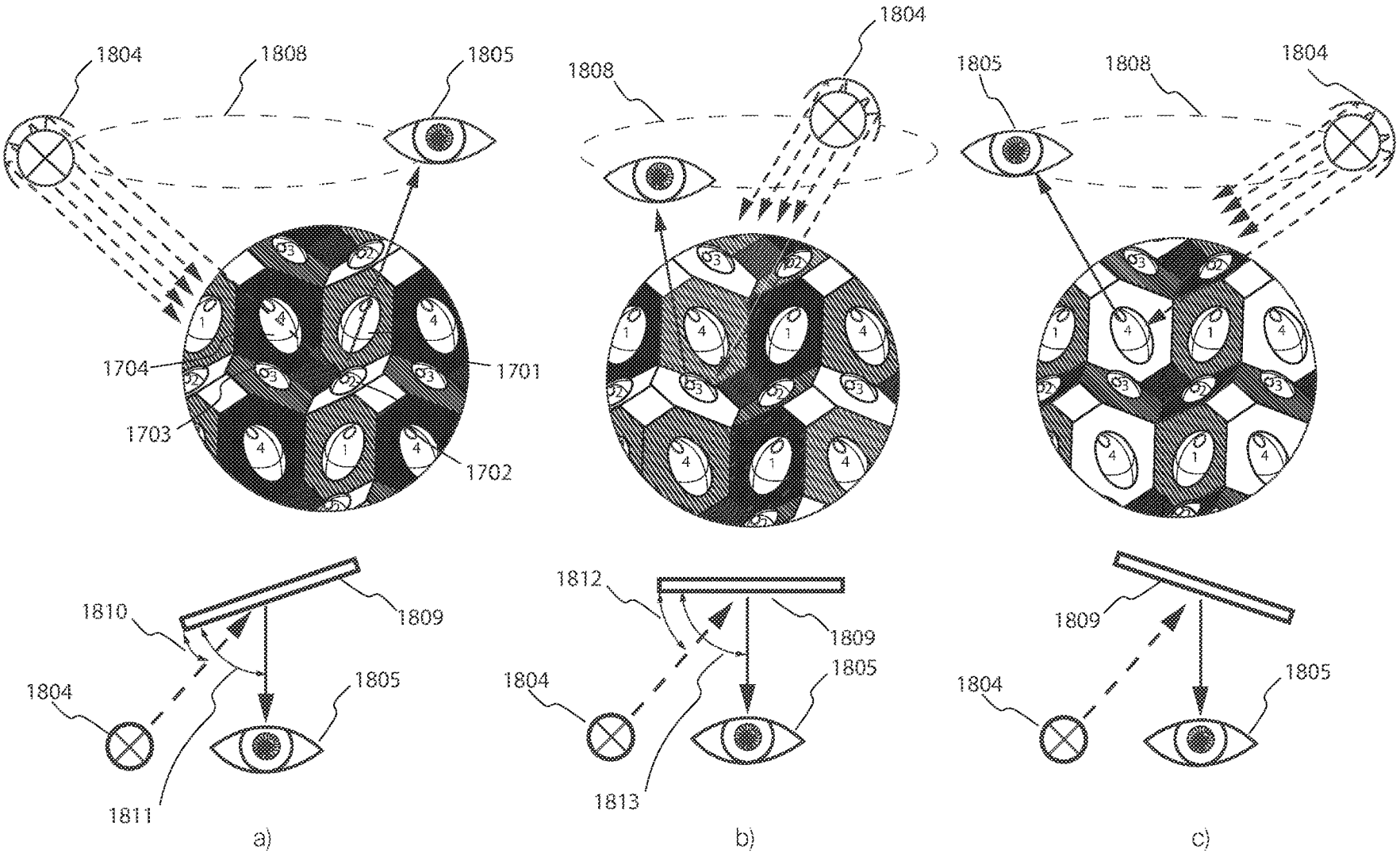
FIGS. 18*a*-18*c* illustrate an embossed foil being viewed by different angles of directional illumination.

FIG. 17(*a*) depicts a further example of the embossed structures in a foil, in a three-dimensional excerpt. The embossed structures are arranged in a regular pattern, which is shown in a two-dimensional representation in FIG. 17(*b*), and comprise embossed light-diffusing elements 1701, 1702, 1703 and 1704. Referring to FIGS. 18(*a*)-18(*c*), these schematically show three different cases of illumination-direction and observation-location pairings, when the embossed structures of FIG. 17(*a*) are illuminated: consecutively, reflective planes for images corresponding to light-diffusing elements 1702, 1703, and 1704 are illuminated by the directional illumination 1804 respectively in FIGS. 18(*a*), 18(*b*) and 18(*c*). Furthermore, observation position and direction 1805 and the directional illumination 1804 have to form an observation plane 1808 in order to create visual image formation. These pairings may be achieved easily by tilting and/or rotating embossed material 1809 and hence changing the illumination and viewing angles and directions as represented schematically in the below parts of FIGS. 18(*a*)-18(*c*). For example, in FIG. 18(*a*) the embossed material 1809 is illuminated in a determined first angle 1810 with the embossed material and viewed in a corresponding second angle 1811 to see the image produced by the light-diffusing elements 1702. In FIG. 18(*b*) the embossed material 1809 is illuminated in a determined third angle 1812, which is distinct from the first angle, and viewed in a corresponding fourth angle 1813 to see the image produced by the light-diffusing elements 1703. Similarly, in FIG. 18(*c*) specific illumination and viewing angles are adopted to view the image produced by the light-diffusing elements 1704.

A limiting element of the image formation is the contrast necessary to create the visual dimming effect of the light-diffusing element, e.g., the light-diffusing element 1402 of FIG. 14(*b*):

with an increasing number of faces on the embossing structure, a size of each individual face (1) may get smaller and hence the difference between the fully reflective and the diffusing cases diminishes. The limit case with an infinite number of faces, i.e., a half-dome approximated by a polyhedron structure allows for an almost infinite number of different reflectivity modulation sites, i.e., such as light-diffusing element 1402, but with almost no reflective area per face.

The illumination has to be directional in order to create a high degree of contrast of the reflected image. Non-directional illumination diffuses the light onto other, non-sought-after reflection planes and hence may interfere with a crisp image formation.

A misalignment between the illumination direction, e.g., 1403, and the viewing angle also reduces the reflected light beam, e.g., 1406, which impinges the observation eye, e.g., 1405, and therefore automatically reduces the contrast of the observed image.

Larger basic embossing structures create normally larger reflective surfaces, but on the other hand increase the graininess of the image. Fine chiseled designs are asking for smaller embossing structures when put onto the same basic surface.

The combination of all four detrimental effects will determine the final quality and the contrast of the picture formed by modulating the reflections on the individual faces of the embossing structure.

Mechanical Tolerances

The embossing pattern according to the invention is for use in fine embossing.

Fine embossing may be defined by mechanical tolerances that are applicable to the manufacture of the fine embossing structures on the rollers, i.e., to positive and negative projections. More precisely, in case of fine embossing, the outline of the embossing structures on the rollers may have a total linear mistake in axial or radial direction of less than +/−7 μm and/or a radial angle mistake of less than 0.4°.

The tolerances for fine embossing structures are applicable for example to the manufacture of positive projection structures P and negative projection structures N of the embossing configuration shown in FIG. 6. The strict tolerances can be understood to be the result of an improved quality at the manufacture of the rollers. The tolerance may be dependent from the quality of surfaces of the rollers. It is therefore an advantage to use relatively hard material for the surface. For example, the tolerances at manufacture may be achieved for rollers made of metal or hard metal, with a surface made of hard metal. Another example of suitable material combination includes a roller made of ceramic material or metal, and covered with a ceramic surface. The material indicated for the example rollers are particularly adapted for manufacture in the area of tolerances for fine embossing. The manufacture of such materials typically requires short-pulsed lasers. It is usually advantageous to cover the surface of the embossing rollers with a suitable protective layer.

In a further preferred embodiment, a roller having a length of 150 mm—thus measured in axial direction—and a diameter of 70 mm will show positioning errors for the projections which may deviate from the desired position by +/−7 μm in radial direction, and ideally +/−7 μm in axial direction, whereby a height of a positive projection or depth of negative projection is in the order of 0.1 mm and this height has a tolerance of +/−5 μm. For an angle of two oblique lateral surfaces that are adjacent, 1 from a positive projection and the other from a negative projection on the counter roller, of for example 80°, it is desired to achieve a tolerance of less than 5°. Hence, rollers manufactured in this way will have a maximal linear mistake of +/−7 μm, and errors resulting from embossing with such rollers will be below 20 μm.

It may only be affirmed that a difference that was explicitly wanted is there if a linear deviation between the positive projection and negative projection of approximately 5 μm or more is present, as well as an angle deviation of at least 4°. The upper limit in the differences between the geometrical structures is set by the requirement that the rollers must in any case be able to cooperate with each other in an undisturbed manner.

As a matter of principle, any mechanical or laser manufacturing fails to produce absolutely plane walls when working on steel because of the natural properties of steel. This of course makes is difficult to determine angles between walls.

Any deliberate difference on an embossed foil, embossed by two corresponding and mutually attributed structures from cooperating rolls, will finally be dependent from the type of foil material, of its consistency as well as of the thickness of the material to be embossed.

Hence, for example, the total linear difference for the embossing of a foil with 30 μm thickness will be around 40 μm, but for the embossing of a foil with, e.g., 300 μm thickness, it will be around 120 μm relative to an axial embossing length of 150 mm.

Shading Structures

The embossing structures according to the invention may—in at least a preferred embodiment—be configured to enable the embossing of additional shading structures intended for producing an optical shading effect when light is projected on the embossed material. Generally speaking, such configuration involves providing at least a lateral surface of a positive and/or a negative projection, on at least one of the rolls in the pair of rolls, with shading structures.

Shading structures have been provided as scratches on material's surfaces in prior art, for example when rendering surfaces of gold wristwatches bodies matt. In the case of thin films or foil materials, such as used to make package innerliners, for example, it was to date only possible to produce shading effects by grading or deforming the pyramids—see for example EP 0 925 911 and EP 1 324 877. When using gradations it remains challenging to produce a local shading effect by which the shadow effect is independent from an angle of view. One exception, which allows obtaining a better contrast, consists in removing embossing structures, generally pyramidal structure—this enables the creation of optical logo surfaces.

The technology known as pixelization involves making on the surfaces of the thin films or foil materials a relatively large number of densely packed and randomly arranged pixels, which have individual heights of for example 10 μm from the embossing surface. This enables to prevent any direct reflection of light projected on the surface rather than having the surface acting as a mirror. Light projected on the thus modified surface may even be absorbed depending on the size of the pixelization. Hence, this allows producing very fine gradations that produce pleasing esthetical effects.

The shading structures fit on the lateral surfaces of the positive and negative projections without impeding the process of fine embossing. In case the positive projections and negative projections have respectively a flattened top or bottom, the shading structures may also be made on the flattened top or bottom surfaces of the projections.

In a further preferred embodiment, the shading structures may for example be fitted on selected lateral surfaces of the truncated pyramid 1102 shown in FIG. 11(*a*).

The invention claimed is:

1. A method of embossing individually light reflecting areas on a foil material, the method comprising:

feeding a foil material into a roller nip between a pair of rollers, the pair of rollers including a motor roller and a counter roller;

wherein the motor roller and counter roller at least in a determined perimeter includes a plurality of positive and negative projections on a checkered layout, positive and negative projections alternate in axial and radial directions, the positive projections of the motor roller together with alternating corresponding negative projections on the counter roller form, during the operation of the rollers and in the roller nip, a first straight line substantially parallel to the axial direction, and the negative projections of the motor roller together with alternating corresponding positive projections on the counter roller form, during the operation of the rollers and in the roller nip, a second straight line substantially parallel to the axial direction, and each positive projection extends from a base surface of a corresponding roller of the pair of rollers to a top side of the positive projection in a direction away from a rotation axis of the corresponding roller, and each negative projection extends from the base surface of a corresponding roller of the pair of rollers to a bottom side of the negative projection in a direction towards the rotation axis of the corresponding, during an embossing operation of the motor roller and the counter roller and in the roller nip, each projection of the motor roller is surrounded on all lateral sides by projections of the counter roller, on a roller each positive or negative projection not situated at the determined perimeter, is axially offset relative to the peripherally adjacent positive or negative projections respectively on the same roller, and the plurality of positive and negative projections of the counter roller seamlessly and gaplessly join with those corresponding negative and positive projections of the motor roller at the intended embossing of the foil material, enabling a homogeneously jointed embossed polyhedron shape in the foil.

each positive and negative projections on the motor roller are shaped as an n- cornered polyhedron with a specific surface to produce on the embossed foil surface a corresponding individually light reflecting area, and each positive projection its specific surface corresponding to its top side, and for each negative projection its specific surface corresponding to its bottom side.

2. The method according to claim 1, wherein in the step of shaping, for the positive projections, the specific surfaces at the top sides belong to a first set of a plurality of specific surfaces, each of the specific surfaces intended to produce on the embossed foil surface a corresponding individually light reflecting area reflecting in respective different directions, and for the negative projections, the specific surfaces of the bottom sides belong to a second set of a plurality of specific surfaces, each of the specific surfaces intended to produce on the embossed foil surface a corresponding individually light reflecting area reflecting in respective different directions.

3. The method according to claim 1, wherein in the step of shaping, for the positive projections, the specific surface extends down to the roller surface.

4. The method according to claim 1, wherein the motor roller and the counter roller include steel, and are removably mounted in an interchangeable unit of an embossing system.

5. The method according to claim 1, wherein the motor roller transmits a drive to the counter roller by toothed wheels.

6. The method according to claim 1, wherein a first set of side surfaces of the n-cornered polyhedron structures, that each extend from a bottom side of a negative projection to a top side of a positive projection, are each arranged parallel to each other and to a first plane; and each of the side surface of the first set are engraved with a first light-diffusing element.

7. The method according to claim 6, wherein a second set of side surfaces of the n-cornered polyhedron structures, that each extend from a bottom side of a negative projection to a top side of a positive projection, are each arranged parallel to each other and to a second plane, the second plane intersecting with the first plane, and each of the side surface of the second set are engraved with a second light diffusing element.

8. The method according to claim 7, wherein the first set of side surfaces is representative of a first pattern, and the second set of side surfaces representative of a second pattern, and when the embossed foil material is illuminated in a determined first angle and viewed in a corresponding second angle, an first image of the first pattern is viewable, and when the embossed foil material is illuminated in a determined third angle distinct from the first angle, and viewed in a corresponding fourth angle, an second image of the second pattern is viewable.

9. A roller stand for embossing individually light reflecting areas on a foil material, the roller stand comprising:

a pair of a first roller and a second roller defining a roller nip within which the foil material is to be fed, wherein each roller being provided at least in a determined perimeter with a plurality of positive and negative projections on a checkered layout, positive and negative projections alternate in axial and radial directions, the positive projections of the motor roller together with alternating corresponding negative projections on the counter roller form, during the operation of the rolls and in the roller nip, a first straight line substantially parallel to the axial direction, the negative projections of the motor roller together with alternating corresponding positive projections on the counter roller form, during the operation of the rollers and in the roller nip, a second straight line substantially parallel to the axial direction, each positive projection extends from a base surface of a corresponding roller to a top side of the positive projection in a direction away from a rotation axis of the corresponding roller, and each negative projection extends from the base surface of a corresponding roller to a bottom side of the negative projection in a direction towards the rotation axis of the corresponding roller, during an embossing operation of the motor roller and the counter roller and in the roller nip, each projection of the motor roller is surrounded on all lateral sides by projections of the counter roller, and on a roller each positive or negative projection not situated at the determined perimeter, is axially offset relative to the peripherally adjacent positive or negative projections respectively on the same roller;

the plurality of positive and negative projections of the counter roller seamlessly and gaplessly join with those corresponding negative and positive projections of the motor roller at the intended embossing of the foil material, enabling a homogeneously jointed embossed polyhedron shape in the foil, and each positive and negative projection on the motor roller is shaped as an n-cornered polyhedron with a specific surface to produce on the embossed foil surface a corresponding individually light reflecting area, for each positive projection its specific surface corresponding to its top side, and for each negative projection its specific surface corresponding to its bottom side.

10. The roller stand according to claim 9, wherein for the positive projections, the specific surfaces at the top sides belong to a first set of a plurality of specific surfaces, each of the specific surfaces intended to produce on the embossed foil surface a corresponding individually light reflecting area reflecting in respective different directions, and for the negative projections the specific surfaces of the bottom sides belong to a second set of a plurality of specific surfaces, each of the specific surfaces intended to produce on the embossed foil surface a corresponding individually light reflecting area reflecting in respective different directions.

11. The roller stand according to claim 9, wherein for the positive projections, the specific surface extends down to the roller surface.

12. The roller stand according to claim 9, wherein the motor roller and the counter roller include steel, and are removably mounted in a interchangeable unit of an embossing system.

13. The roller stand according to claim 9, wherein the motor roller transmits its drive to the counter roller by toothed wheels.

14. The roller stand according to claim 9, wherein a first set of side surfaces of the n-cornered polyhedron structures, that each extend from a bottom side of a negative projection to a top side of a positive projection, are each arranged parallel to each other and to a first plane; and each of the side surface of the first set are engraved with a first light-diffusing element.

15. The roller stand according to claim 9, wherein a second set of side surfaces of the n-cornered polyhedron structures, that each extend from a bottom side of a negative projection to a top side of a positive projection, are each arranged parallel to each other and to a second plane, the second plane intersecting with the first plane, and each of the side surface of the second set are engraved with a second light diffusing element.

* * * * *